US010648643B2

(12) United States Patent
Edmond et al.

(10) Patent No.: US 10,648,643 B2
(45) Date of Patent: May 12, 2020

(54) DOOR FRAME TROFFER

(71) Applicant: Ideal Industries Lighting LLC, Durham, NC (US)

(72) Inventors: Mark Edmond, Raleigh, NC (US); Dong Lu, Cary, NC (US); Paul Pickard, Morrisville, NC (US)

(73) Assignee: Ideal Industries Lighting LLC, Sycamore, IL (US)

( * ) Notice: Subject to any disclaimer, the term of this patent is extended or adjusted under 35 U.S.C. 154(b) by 0 days.

(21) Appl. No.: 13/828,348

(22) Filed: Mar. 14, 2013

(65) Prior Publication Data

US 2014/0268692 A1 Sep. 18, 2014

(51) Int. Cl.
*F21V 21/06* (2006.01)
*F21V 7/00* (2006.01)
(Continued)

(52) U.S. Cl.
CPC ..... *F21V 7/005* (2013.01); *F21S 4/28* (2016.01); *F21S 8/026* (2013.01); *F21V 5/008* (2013.01);
(Continued)

(58) Field of Classification Search
CPC ..... F21Y 2013/003; F21Y 2113/002; F21Y 2113/005; F21V 7/0008; F21V 33/006; F21V 7/005; F21V 13/04; F21V 5/02; F21V 7/00; F21V 5/008; F21V 5/04; F21S 8/026; F21S 4/008; F21S 4/003; F21S 8/02; F21S 8/04; F21S 8/033
(Continued)

(56) References Cited

U.S. PATENT DOCUMENTS

D85,382 S 10/1931 Guth ..... D26/24
2,356,654 A 8/1944 Cullman ..... 200/84 C
(Continued)

FOREIGN PATENT DOCUMENTS

CN 1762061 4/2006
CN 1934389 3/2007
(Continued)

OTHER PUBLICATIONS

Preliminary Report and Written Opinion from PCT appl. No. PCT/US2012/047084, dated Feb. 6, 2014.
(Continued)

*Primary Examiner* — Arman B Fallahkhair
(74) *Attorney, Agent, or Firm* — Myers Bigel, P.A.

(57) ABSTRACT

An indirect troffer. Embodiments of the present invention provide a troffer-style fixture that is particularly well-suited for use with solid state light sources, such as LEDs. The troffer comprises light bars mounted proximate to a back reflector. A back reflector defines a reflective interior surface of the lighting troffer. To facilitate thermal dissipation, the light bar can act as a heat sink. A portion of the heat sink is exposed to the ambient room environment while another portion functions as a mount surface for the light sources that faces the back reflector. One or more light sources disposed along the light bar mount surface emit light into an interior cavity where it can be mixed and/or shaped prior to emission. In some embodiments, one or more lens plates extend from the light bar out to the back reflector.

24 Claims, 17 Drawing Sheets

(51) Int. Cl.

| | |
|---|---|
| ***F21V 13/04*** | (2006.01) |
| ***F21S 8/02*** | (2006.01) |
| ***F21V 5/00*** | (2018.01) |
| ***F21V 5/04*** | (2006.01) |
| ***F21S 4/28*** | (2016.01) |
| *F21S 10/00* | (2006.01) |
| *A47G 19/22* | (2006.01) |
| *F21S 6/00* | (2006.01) |
| *F21W 121/00* | (2006.01) |
| *F21V 9/12* | (2006.01) |
| *G09F 13/04* | (2006.01) |
| *F21Y 113/13* | (2016.01) |
| *F21Y 115/10* | (2016.01) |
| *F21Y 107/00* | (2016.01) |

(52) U.S. Cl.

CPC ..... *F21V 5/04* (2013.01); *F21V 7/0008* (2013.01); *F21V 13/04* (2013.01); *A47G 19/2255* (2013.01); *F21S 6/002* (2013.01); *F21S 10/002* (2013.01); *F21V 9/12* (2013.01); *F21W 2121/00* (2013.01); *F21Y 2107/00* (2016.08); *F21Y 2113/13* (2016.08); *F21Y 2115/10* (2016.08); *G09F 13/04* (2013.01)

(58) Field of Classification Search

USPC ..... 362/145, 147, 148, 150, 223, 225, 373, 362/375, 217.05, 249.02, 249.11, 217.01, 362/217.02, 217.15, 222, 235, 45

See application file for complete search history.

(56) References Cited

U.S. PATENT DOCUMENTS

| | | | | |
|---|---|---|---|---|
| 3,381,124 | A | 4/1968 | Eisenberg | 362/354 |
| 3,743,826 | A | 7/1973 | Halfaker | |
| 3,790,774 | A | 2/1974 | Miller | |
| 4,939,627 | A | 7/1990 | Herst et al. | 362/299 |
| 5,025,356 | A | 6/1991 | Gawad | 362/221 |
| 5,526,190 | A | 6/1996 | Hubble, III | 347/102 |
| 5,823,663 | A | 10/1998 | Bell et al. | 362/362 |
| D407,473 | S | 3/1999 | Wimbock | D23/328 |
| 6,079,851 | A | 6/2000 | Altman | |
| 6,102,550 | A | 8/2000 | Edward, Jr. | |
| 6,149,283 | A * | 11/2000 | Conway et al. | 362/236 |
| 6,155,699 | A | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |
| 6,402,347 | B1 | 6/2002 | Maas et al. | 362/294 |
| 6,443,598 | B1 | 9/2002 | Morgan | 362/342 |
| 6,523,974 | B2 | 2/2003 | Engel | 362/224 |
| 6,578,979 | B2 | 6/2003 | Truttmann-Battig | 362/92 |
| 6,598,998 | B2 | 7/2003 | West | 257/E33.073 |
| D496,121 | S | 9/2004 | Santoro | D26/74 |
| 6,871,983 | B2 | 3/2005 | Jacob et al. | 362/364 |
| 6,948,838 | B2 | 9/2005 | Kunstler | 362/237 |
| 6,948,840 | B2 | 9/2005 | Grenda et al. | 362/555 |
| 6,951,415 | B2 | 10/2005 | Amano | 362/297 |
| 7,021,797 | B2 | 4/2006 | Minano et al. | 362/355 |
| 7,049,761 | B2 | 5/2006 | Timmermans et al. | 315/246 |
| 7,063,449 | B2 | 6/2006 | Ward | 345/102 |
| 7,111,969 | B2 | 9/2006 | Bottesch | 362/299 |
| 7,175,296 | B2 | 2/2007 | Cok | 362/147 |
| 7,213,940 | B1 | 5/2007 | Van de Ven et al. | 362/231 |
| 7,217,004 | B2 | 5/2007 | Park | 362/240 |
| 7,237,924 | B2 | 7/2007 | Martineau et al. | 362/231 |
| D556,358 | S | 11/2007 | Santoro | D26/74 |
| 7,338,182 | B1 | 3/2008 | Hastings et al. | 362/150 |
| 7,341,358 | B2 | 3/2008 | Hsieh | 362/97.1 |
| 7,510,299 | B2 | 3/2009 | Timmermans et al. | 362/225 |
| 7,520,636 | B2 * | 4/2009 | Van Der Poel | F21V 7/0008 362/290 |
| D593,246 | S | 5/2009 | Fowler et al. | D26/76 |
| 7,559,672 | B1 | 7/2009 | Parkyn et al. | 362/244 |
| 7,594,736 | B1 | 9/2009 | Kassay et al. | 362/223 |
| D604,446 | S | 11/2009 | Fowler et al. | D26/76 |
| 7,618,157 | B1 | 11/2009 | Galvez et al. | 362/294 |
| 7,618,160 | B2 | 11/2009 | Chinniah et al. | 362/326 |
| D608,932 | S | 1/2010 | Castelli | D26/76 |
| 7,654,688 | B2 | 2/2010 | Li | |
| 7,654,702 | B1 | 2/2010 | Ding et al. | 362/294 |
| 7,661,844 | B2 | 2/2010 | Sekiguchi et al. | 362/249 |
| D611,183 | S | 3/2010 | Duarte | D26/76 |
| 7,674,005 | B2 | 3/2010 | Chung et al. | 362/223 |
| 7,686,470 | B2 * | 3/2010 | Chiang | 362/147 |
| 7,686,484 | B2 | 3/2010 | Heiking et al. | 362/375 |
| 7,712,918 | B2 | 5/2010 | Siemiet et al. | 362/241 |
| 7,722,220 | B2 | 5/2010 | Van de Ven | 362/294 |
| 7,722,227 | B2 | 5/2010 | Zhang et al. | 362/364 |
| D617,487 | S | 6/2010 | Fowler et al. | D26/76 |
| 7,768,192 | B2 | 8/2010 | Van de Ven et al. | 313/503 |
| 7,815,338 | B2 | 10/2010 | Siemiet et al. | 362/218 |
| 7,824,056 | B2 * | 11/2010 | Madireddi et al. | 362/125 |
| 7,828,468 | B2 | 11/2010 | Mayfield et al. | 362/342 |
| 7,868,484 | B2 | 1/2011 | Groff et al. | 362/375 |
| D633,247 | S | 2/2011 | Kong et al. | D26/88 |
| 7,922,354 | B2 | 4/2011 | Everhart | 362/235 |
| 7,926,982 | B2 | 4/2011 | Liu | 362/294 |
| 7,959,332 | B2 | 6/2011 | Tickner | |
| 7,988,321 | B2 | 8/2011 | Wung et al. | 362/218 |
| 7,988,335 | B2 | 8/2011 | Liu et al. | 362/294 |
| 7,991,257 | B1 | 8/2011 | Coleman | 264/1.24 |
| 7,993,034 | B2 | 8/2011 | Wegner | 362/296.05 |
| 7,997,762 | B2 | 8/2011 | Wang et al. | 362/249 |
| 8,038,314 | B2 * | 10/2011 | Ladewig | 362/217.12 |
| 8,038,318 | B2 | 10/2011 | Plunk | |
| 8,038,321 | B1 * | 10/2011 | Franck et al. | 362/249.02 |
| 8,070,326 | B2 | 12/2011 | Lee | 362/307 |
| D653,376 | S | 1/2012 | Kong et al. | D26/76 |
| 8,092,043 | B2 | 1/2012 | Lin et al. | 362/249.02 |
| 8,092,049 | B2 | 1/2012 | Kinnune et al. | 362/294 |
| 8,096,671 | B1 | 1/2012 | Cronk | 362/147 |
| D657,488 | S | 4/2012 | Lown et al. | D26/120 |
| 8,162,504 | B2 | 4/2012 | Zhang et al. | 362/217 |
| 8,186,855 | B2 | 5/2012 | Wassel et al. | 362/373 |
| 8,197,086 | B2 | 6/2012 | Watanabe et al. | 362/218 |
| 8,201,968 | B2 | 6/2012 | Maxik et al. | |
| 8,215,799 | B2 | 7/2012 | Vanden Eynden et al. | 362/294 |
| 8,246,219 | B2 | 8/2012 | Teng | 362/217.02 |
| 8,256,927 | B2 | 9/2012 | Hu | 362/218 |
| 8,287,160 | B2 | 10/2012 | Shen | |
| D670,849 | S | 11/2012 | Lay et al. | D26/74 |
| 8,317,354 | B2 | 11/2012 | Gassner et al. | 362/147 |
| 8,376,578 | B2 * | 2/2013 | Kong | F21V 23/06 362/249.02 |
| D676,848 | S | 4/2013 | Pickard et al. | D26/74 |
| 8,410,514 | B2 | 4/2013 | Kim | 257/99 |
| D684,291 | S | 6/2013 | Goelz et al. | D26/74 |
| 8,480,252 | B2 | 7/2013 | Bertram et al. | 362/243 |
| 8,506,135 | B1 | 8/2013 | Oster | 362/373 |
| 8,523,383 | B1 | 9/2013 | Grigore | |
| 8,556,452 | B2 | 10/2013 | Simon | 362/217.07 |
| 8,591,058 | B2 | 11/2013 | Concepcion | 362/231 |
| 8,591,071 | B2 | 11/2013 | Hochstein | 362/294 |
| 8,602,601 | B2 | 12/2013 | Khazi | |
| 8,616,723 | B2 | 12/2013 | Zhang | 362/218 |
| D698,975 | S | 2/2014 | Blessit et al. | D26/74 |
| 8,641,243 | B1 | 2/2014 | Rashidi | 362/373 |
| D701,988 | S | 4/2014 | Clements | D26/74 |
| 8,696,154 | B2 | 4/2014 | Hutchens | 362/217.05 |
| 8,702,264 | B1 | 4/2014 | Rashidi | 362/147 |
| 8,764,244 | B2 | 7/2014 | Jeon | 362/218 |
| D714,988 | S | 10/2014 | Park et al. | D26/74 |
| D721,198 | S | 1/2015 | Glasbrenner | D26/76 |
| 9,010,956 | B1 | 4/2015 | Davis | |
| 9,052,075 | B2 | 6/2015 | Demuynck et al. | |
| 2003/0063476 | A1 | 4/2003 | English et al. | |
| 2004/0001344 | A1 | 1/2004 | Hecht | |
| 2004/0085779 | A1 | 5/2004 | Pond et al. | 362/516 |
| 2004/0100796 | A1 | 5/2004 | Ward | |
| 2004/0240230 | A1 | 12/2004 | Kitajima | 362/558 |
| 2005/0180135 | A1 | 8/2005 | Mayer | 362/240 |

(56) References Cited

U.S. PATENT DOCUMENTS

| | | | | |
|---|---|---|---|---|
| 2005/0264716 | A1 | 12/2005 | Kim et al. | |
| 2005/0281023 | A1 | 12/2005 | Gould | |
| 2006/0221611 | A1 | 10/2006 | No | 362/247 |
| 2006/0245208 | A1 | 11/2006 | Sakamoto | |
| 2006/0262521 | A1 | 11/2006 | Piepgras et al. | 362/149 |
| 2006/0279671 | A1 | 12/2006 | Han | |
| 2006/0291206 | A1 | 12/2006 | Angelini et al. | 362/244 |
| 2007/0070625 | A1 | 3/2007 | Bang | 362/240 |
| 2007/0109779 | A1 | 5/2007 | Sekiguchi et al. | |
| 2007/0115670 | A1 | 5/2007 | Roberts et al. | |
| 2007/0115671 | A1 | 5/2007 | Roberts et al. | |
| 2007/0211457 | A1 | 9/2007 | Mayfield et al. | 362/223 |
| 2007/0253205 | A1 | 11/2007 | Welker | 362/373 |
| 2007/0279910 | A1 | 12/2007 | Lin | |
| 2007/0297181 | A1 | 12/2007 | Mayfield et al. | 362/342 |
| 2008/0019147 | A1 | 1/2008 | Erchak | 362/607 |
| 2008/0037284 | A1 | 2/2008 | Rudisill | 362/629 |
| 2008/0049422 | A1 | 2/2008 | Trenchard et al. | 362/238 |
| 2008/0232093 | A1* | 9/2008 | Kim | 362/147 |
| 2008/0278943 | A1 | 11/2008 | Van Der Poel | 362/240 |
| 2008/0303977 | A1 | 12/2008 | Sekiguchi | |
| 2009/0034247 | A1 | 2/2009 | Boyer | 362/225 |
| 2009/0073693 | A1 | 3/2009 | Nall | 362/249.02 |
| 2009/0161356 | A1 | 6/2009 | Negley et al. | 362/231 |
| 2009/0168439 | A1 | 7/2009 | Chiang | 362/404 |
| 2009/0196024 | A1 | 8/2009 | Heiking et al. | 362/150 |
| 2009/0225543 | A1 | 9/2009 | Jacobson et al. | |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2009/0310354 | A1 | 12/2009 | Zampini et al. | 362/235 |
| 2009/0323334 | A1 | 12/2009 | Roberts et al. | |
| 2010/0039579 | A1 | 2/2010 | Park | |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0142202 | A1 | 6/2010 | Sugishita | |
| 2010/0172133 | A1 | 7/2010 | Liu | 362/235 |
| 2010/0172152 | A1* | 7/2010 | Boonekamp | F21V 7/0008 362/609 |
| 2010/0177532 | A1 | 7/2010 | Simon et al. | |
| 2010/0188609 | A1 | 7/2010 | Matsuki et al. | |
| 2010/0253591 | A1 | 10/2010 | Hwu et al. | 345/1.3 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0271843 | A1* | 10/2010 | Holten et al. | 362/609 |
| 2010/0277905 | A1 | 11/2010 | Janik et al. | 362/235 |
| 2010/0277934 | A1 | 11/2010 | Oquendo, Jr. | 362/433 |
| 2010/0295468 | A1 | 11/2010 | Pedersen et al. | 315/294 |
| 2010/0302778 | A1 | 12/2010 | Dabiet | |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | 362/235 |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li | 362/235 |
| 2011/0156584 | A1 | 6/2011 | Kim | 315/32 |
| 2011/0164417 | A1* | 7/2011 | Huang | 362/235 |
| 2011/0175533 | A1 | 7/2011 | Homan | 315/130 |
| 2011/0199005 | A1 | 8/2011 | Bretschneider et al. | |
| 2011/0199769 | A1 | 8/2011 | Bretschneider et al. | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0267823 | A1 | 11/2011 | Angelini et al. | 362/277 |
| 2011/0286225 | A1 | 11/2011 | Konishi | |
| 2011/0305024 | A1 | 12/2011 | Chang | 362/294 |
| 2012/0033420 | A1 | 2/2012 | Kim et al. | 362/235 |
| 2012/0038289 | A1 | 2/2012 | Jee et al. | 315/291 |
| 2012/0051041 | A1* | 3/2012 | Edmond et al. | 362/231 |
| 2012/0120658 | A1 | 5/2012 | Wilk | |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Huang et al. | |
| 2012/0206926 | A9 | 8/2012 | Chou | |
| 2012/0320576 | A1 | 12/2012 | Wald | |
| 2013/0235568 | A1* | 9/2013 | Green et al. | 362/218 |
| 2013/0242550 | A1 | 9/2013 | Suen | |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 101660715 | | 3/2010 |
| CN | 101776254 | | 7/2010 |
| CN | 101776254 | A | 7/2010 |
| CN | 101790660 | | 7/2010 |
| CN | 101790660 | A | 7/2010 |
| CN | 102072443 | | 5/2011 |
| CN | 202580962 | | 12/2012 |
| DE | 102007030186 | | 1/2009 |
| DE | 102007030186 | A | 1/2009 |
| DE | 202010001832 | | 7/2010 |
| EP | 1298383 | | 4/2003 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | | 10/2007 |
| EP | 1847762 | A2 | 10/2007 |
| EP | 1860467 | | 11/2007 |
| EP | 2287520 | A2 | 2/2011 |
| EP | 2290690 | A2 | 3/2011 |
| EP | 2636945 | A2 | 9/2013 |
| GB | 774198 | | 5/1957 |
| JP | 1069809 | | 3/1998 |
| JP | 2002244027 | | 11/2002 |
| JP | U3097327 | | 8/2003 |
| JP | 2004140327 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO 03102467 | | 11/2003 |
| WO | WO 2009030233 | | 3/2009 |
| WO | WO 2009140761 | A1 | 11/2009 |
| WO | WO 2009157999 | | 12/2009 |
| WO | WO 2009157999 | A | 12/2009 |
| WO | WO 2009157999 | A1 | 12/2009 |
| WO | WO 2010024583 | | 3/2010 |
| WO | WO 2010024583 | A2 | 3/2010 |
| WO | WO 2010042216 | | 4/2010 |
| WO | Wo 2010042216 | A2 | 4/2010 |
| WO | WO 2011074424 | A1 | 6/2011 |
| WO | WO 2011096098 | A1 | 8/2011 |
| WO | WO 2011098191 | | 8/2011 |
| WO | WO 2011118991 | A2 | 9/2011 |
| WO | WO 2011140353 | A2 | 11/2011 |
| WO | WO 03102467 | | 12/2013 |

OTHER PUBLICATIONS

Office Action from U.S. Appl. No. 13/429,080, dated Apr. 18, 2014.
Office Action from U.S. Appl. No. 12/961,385, dated Mar. 11, 2014.
Reasons for Rejection from Japanese Patent Appl. No. 2013-543207, dated May 20, 2014.

(56) References Cited

OTHER PUBLICATIONS

First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741. dated Jun. 6, 2014.
WhiteOpticsTM (New Castle, DE) White97 Film,,Technical Data Sheet. 1 page.
WhiteOpticsTM (New Castle, DE) Metal. Technical Data Sheet. 1 page.
U.S. Appl. No. 13/345,215, filed Jan. 6, 2012, Lu, et al.
U.S. Appl. No. 13/442,311, filed Apr. 9, 2012, Lu, et al.
U.S. Appl. No. 13/453,924, filed Apr. 23, 2012, Pickard, et al.
U.S. Appl. No. 12/463,709, filed May 11, 2009, Donofrio, et al.
U.S. Appl. No. 11/656,759, filed Jan. 22, 2007, Chitnis, et al.
U.S. Appl. No. 11/899,790, filed Sep. 7, 2007, Chitnis, et al.
U.S. Appl. No. 13/088,690, filed Apr. 18, 2011, Pickard, et al.
U.S. Appl. No. 13/672,592, filed Nov. 8, 2012, Dixon, et al.
International Search Report and Written Opinion from PCT Application No. PCT/US2013/021053, dated Apr. 17, 2013.
XLamp® C family from Cree®, Inc., Product Family Data Sheet, 15 pages.
XLamp® M family from Cree®, Inc., Product Family Data Sheet, 14 pages.
XLamp® X family from Cree®, Inc., Product Family Data Sheet, 17 pages.
Energy Star® Program Requirements for Solid State Lighting Luminaires, Eligibility Criteria—Version 1.1, final: Dec. 19, 2008.
Assist Recommends . . . LED Life for General Lighting: Definition of Life, vol. 1, Issue 1, Feb. 2005.
"IES Approved Method for Measuring Lumen Maintenance of LED light Sources", Sep. 22, 2008, ISBN No. 978-0-87995-227-3, (LM-80).
U.S. Appl. No. 13/649,052, filed Oct. 10, 2012, Lowes, et al.
U.S. Appl. No. 13/649,067, filed Oct. 10, 2012, Lowes, et al.
U.S. Appl. No. 13/207,204, filed Aug. 10, 2011, Athalye, et al.
U.S. Appl. No. 13/365,844.
U.S. Appl. No. 13/662,618, filed Oct. 29, 2012.
U.S. Appl. No. 13/462,388, filed May 2, 2012.
Office Action from Japanese Design Patent Application No. 2011-18570.
Reason for Rejection from Japanese Design Patent Application No. 2011-18571.
Reason for Rejection from Japanese Design Patent Application No. 2011-18572.
International Search Report and Written Opinion for PCT Application No. PCT/US2011/062396, dated Jul. 13, 2012.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
U.S. Appl. No. 12/873,303, filed Aug. 31, 2010 to Edmond, et al.
U.S. Appl. No. 12/961,385, filed Dec. 6, 2010 to Pickard, et al.
Cree's XLamp XP-E LED's. data sheet, pp. 1-16.
Cree's XLamp XP-G LED's, data sheet, pp. 1-12.
International Search Report and Written Opinion for Patent Application No. PCT/US2011/001517, dated Feb. 27, 2012.
U.S. Appl. No. 12/418,796, filed Apr. 6, 2009.
U.S. Appl. No. 13/429,080, filed Mar. 23, 2012.
U.S. Appl. No. 13/028,946, filed Feb. 16, 2011.
U.S. Appl. No. 13/306,589, filed Nov. 29, 2011.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Office Action from U.S. Appl. No. 13/464,745, dated Jul. 16, 2014.
International Preliminary Report on Patentability and Written Opinion from PCT/US2013/021053, dated Aug. 21, 2014.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
International Search Report and Written Opinion from PCT/US2013/049225, dated Oct. 24, 2013.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
International Search Report and Written Opinion from Appl. No. PCT/CN2013/072772, dated Dec. 19, 2013.
Communication from European Patent Appl. No. 13701525.1-1757, dated Sep. 26, 2014.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035666, dated Oct. 14, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No 12/961,385, dated Nov. 6, 2014.
Office Action from U.S. Appl. No. 13/453,924, dated Nov. 7, 2014.
First Official Action from European Patent Appl. No. 12 743 003.1-1757, dated Jan. 16, 2015.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
First Office Action from Chinese Patent Appl. No. 2012800369142, dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/368,217, dated May 13, 2015.
Notice of Completion of Pretrial Re-examination from Japanese Patent appl. No. 2013-543207. dated Jun. 30. 2015.
Pretrial Report from Japanese Appl. No. 2013-543207, dated Jun. 19, 2015.

(56) References Cited

OTHER PUBLICATIONS

Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; dated Jan. 6, 2016.
Office Action from U.S. Appl. No. 13/341,741; dated Jan. 8, 2016.
Office Action from U.S. Appl. No. 13/873,303; dated Feb. 2, 2016.
Office Action from U.S. Appl. No. 12/961,385, dated Nov. 27, 2015.
Office Action from U.S. Appl. No. 14/020,757, dated Nov. 24, 2014.
First Office Action from Chinese Patent Appl. No. 2011800588770, dated Sep. 25, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Office Action from U.S. Appl. No. 13/464,745; dated Mar. 1, 2016.
Office Action from U.S. Appl. No. 14/716,480; dated Mar. 3, 2016.
Office Action from U.S. Appl. No. 13/368,217; dated Mar. 4, 2016.
Office Action from U.S. Appl. No. 13/189,535; dated Mar. 18, 2016.
Office Action from U.S. Appl. No. 14/020,757; dated Apr. 7, 2016.
Office Action from U.S. Appl. No. 29/466,391; dated May 10, 2016.
Second Office Action for Application No. 2011800588770; dated Mar. 29, 2016.
Notice of Reason for Rejection for Japanese Appl. No. 2013-543207; dated May 24, 2016.
Office Action for U.S. Appl. No. 14/020,757; dated Jul. 19, 2016.
Examination Report from Taiwan Application No. 100131021; dated Jul. 21, 2016.
Office Action for U.S. Appl. No. 14/716,480; dated Aug. 26, 2016.
European Summons for Oral Proceedings for Application No. 12743003.1; Dated Sep. 2, 2016.
Office Action for U.S. Appl. No. 13/464,745; dated Sep. 7, 2016.
Office Action for Chinese Patent Application No. 2011800588770; dated Sep. 26, 2016.
Notification of Reexamination for Chinese Application No. 2011800529984; dated Oct. 10, 2016.
Office Action for European Application No. 11754767.9: dated Oct. 31, 2016.
Office Action for U.S. Appl. No. 12/873,303; dated Nov. 25, 2016.
Notice of Allowance for Taiwan Application No. 100131021; dated Nov. 28, 2016.
Office Action for U.S. Appl. No. 13/368,217; dated Jan. 3, 2017.
Office Action for U.S. Appl. No. 14/225,327; dated Mar. 14, 2017.
European Notice of Allowance for Application No. 12743003.1; dated Mar. 17, 2017.
Office Action for U.S. Appl. No. 13/189,535; dated Mar. 23, 2017.
Office Action for U.S. Appl. No. 13/464,745; dated Mar. 23, 2017.
Foreign Office Action for Chinese Application No. 2011800529984; dated Apr. 5, 2017.
Office Action for U.S. Appl. No. 14/721,806; dated Apr. 21, 2017.
Office Action for U.S. Appl. No. 13/443,630; dated May 18, 2017.
Office Action for U.S. Appl. No. 14/170,627; dated Jun. 16, 2017.
Office Action for U.S. Appl. No. 14/716,480; dated Jul. 5, 2017.
Office Action for U.S. Appl. No. 12/873,303; dated Aug. 9, 2017.
Office Action for U.S. Appl. No. 13/189,535; dated Apr. 5, 2018.
Office Action for U.S. Appl. No. 14/225,327; dated Apr. 19, 2018.
Office Action for U.S. Appl. No. 13/464,745; dated May 2, 2018.
Foreign Office Action for European Application No. 11754767.9; dated May 7, 2018.
Office Action for U.S. Appl. No. 14/225,327; dated Oct. 2, 2017.
Office Action for U.S. Appl. No. 13/189,535; dated Oct. 30, 2017.
Office Action for U.S. Appl. No. 14/721,806; dated Nov. 1, 2017.
Office Action for U.S. Appl. No. 14/170,627; dated Nov. 29, 2017.
Office Action for U.S. Appl. No. 13/464,745; dated Dec. 11, 2017.
Office Action for U.S. Appl. No. 14/716,480; dated Jan. 17, 2018.

* cited by examiner

FIG. 1
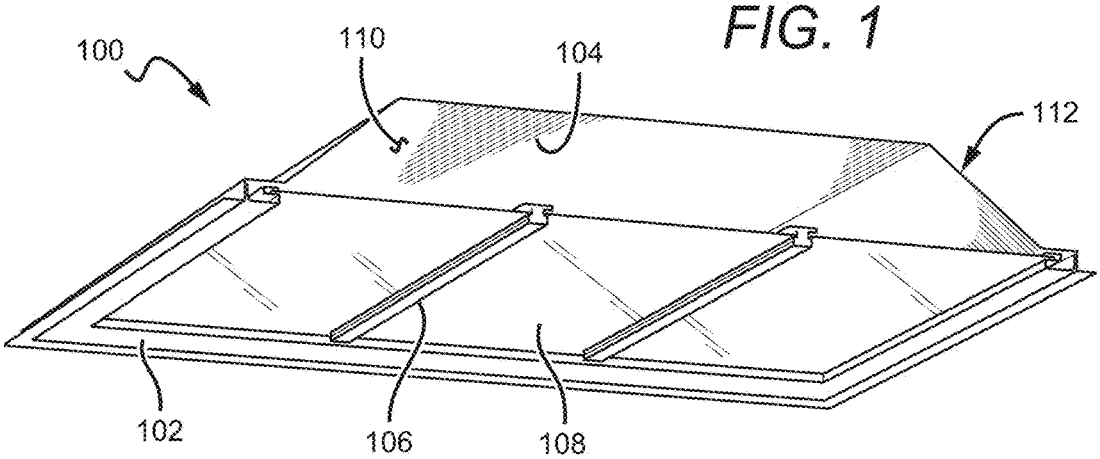
FIG. 2A
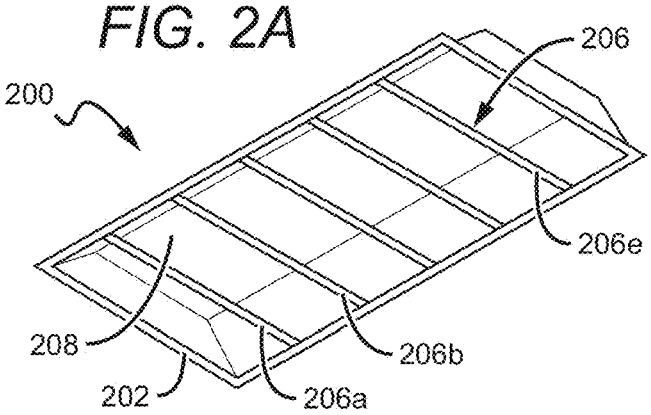
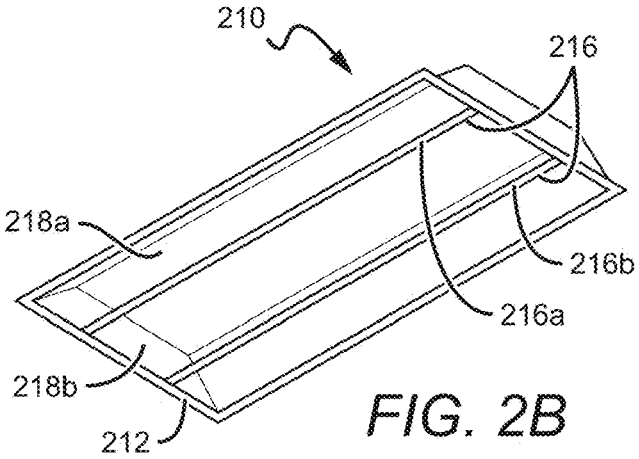
FIG. 2B
FIG. 2C
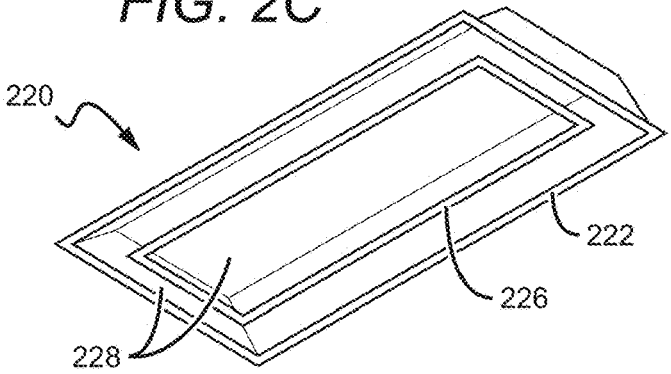

FIG. 2D
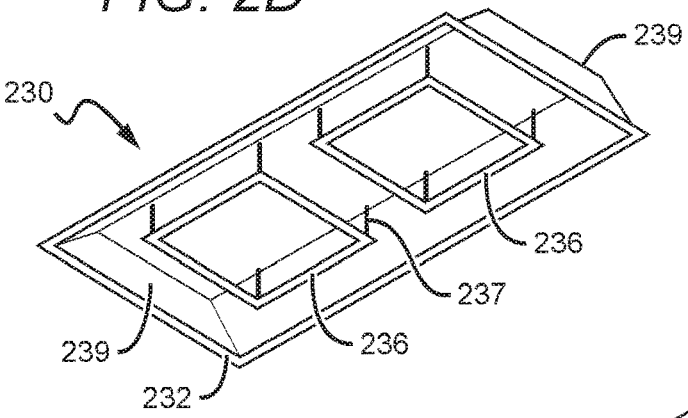
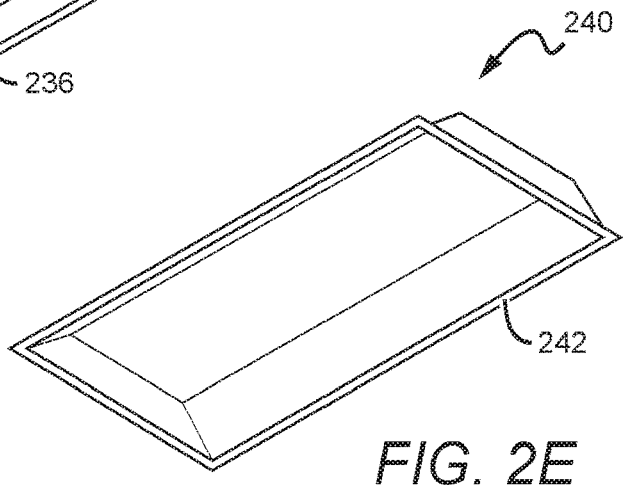
FIG. 2E
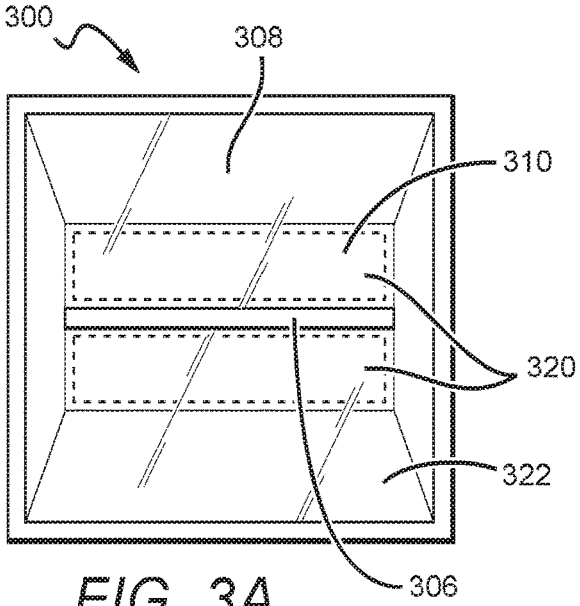
FIG. 3A
PRIOR ART
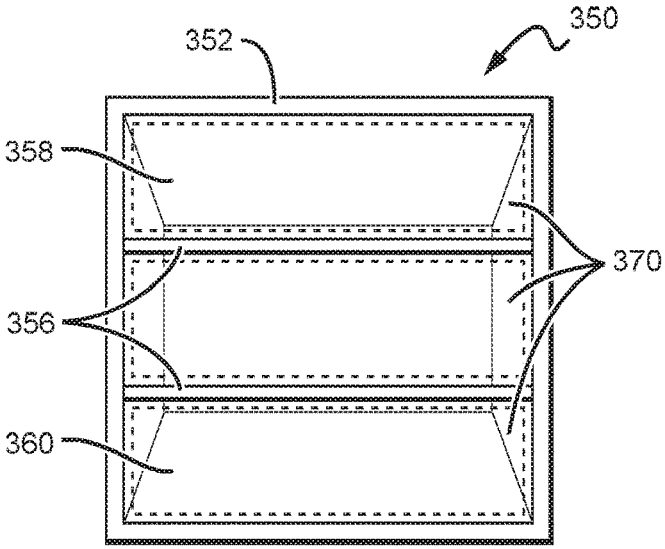
FIG. 3B FIG. 5A
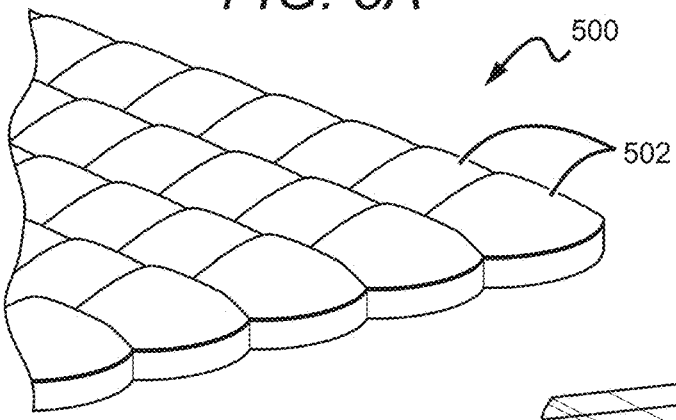
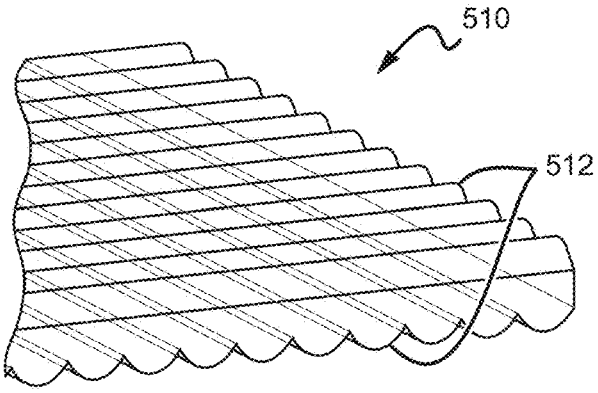
FIG. 5B
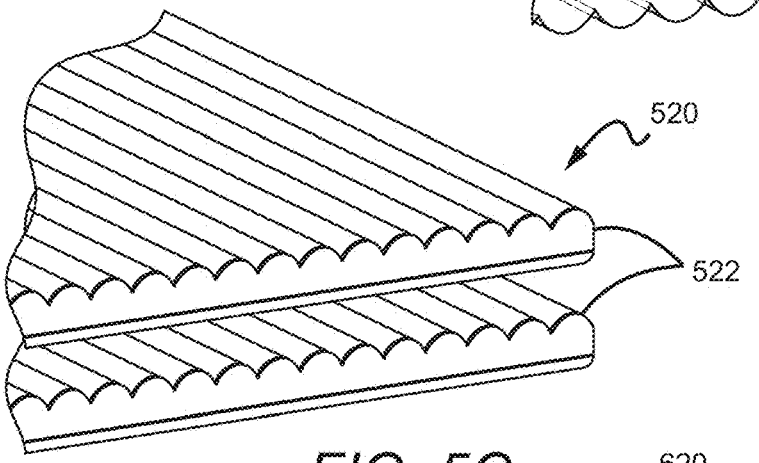
FIG. 5C
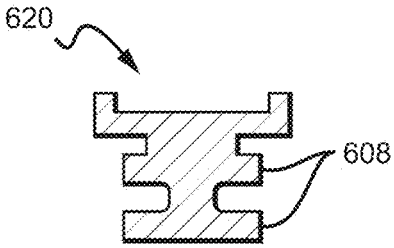
FIG. 6B
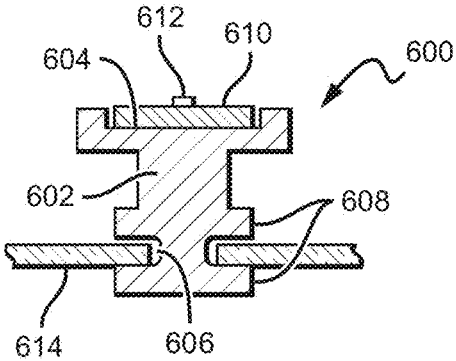
FIG. 6A
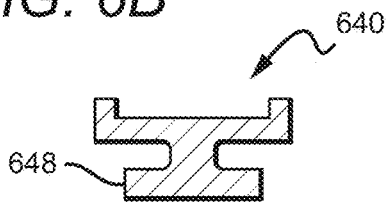
FIG. 6C FIG. 6D
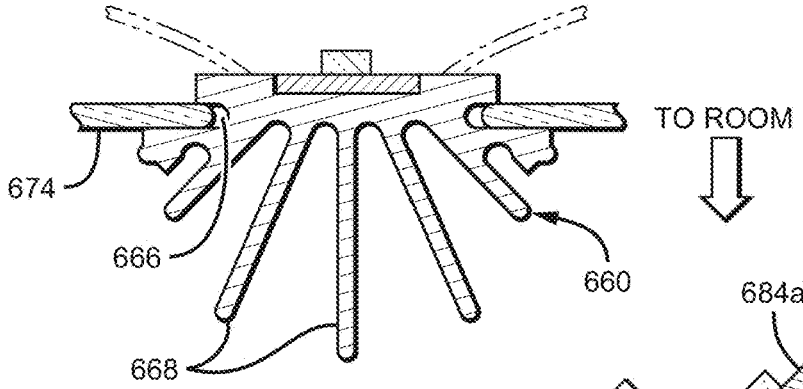
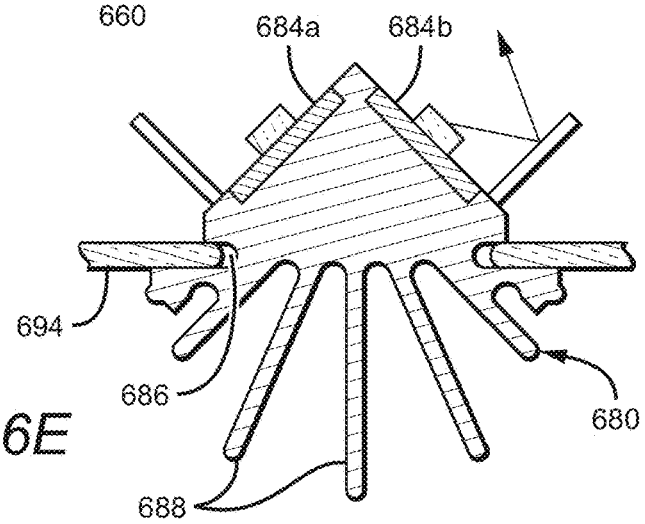
FIG. 6E
FIG. 7A
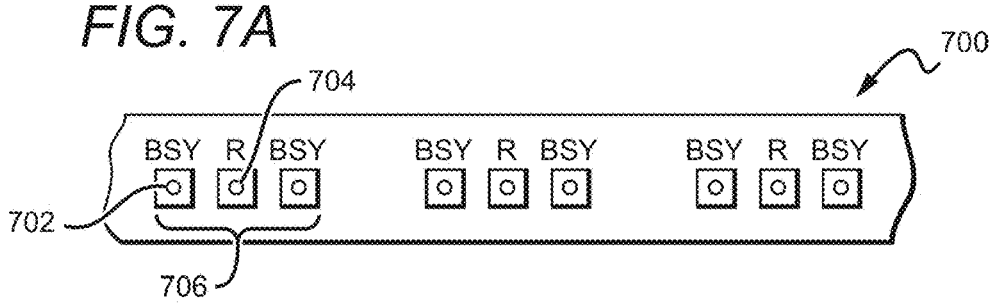
FIG. 7B
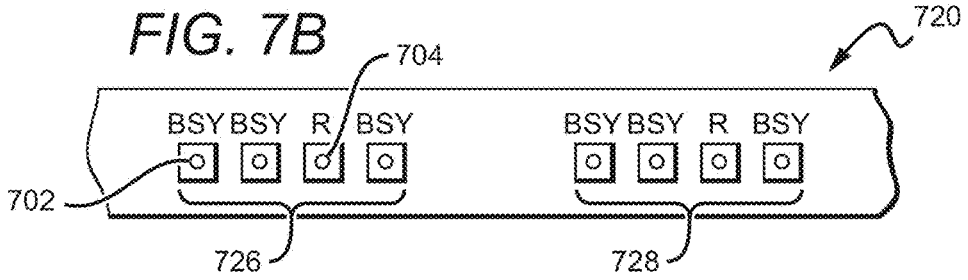
FIG. 7C
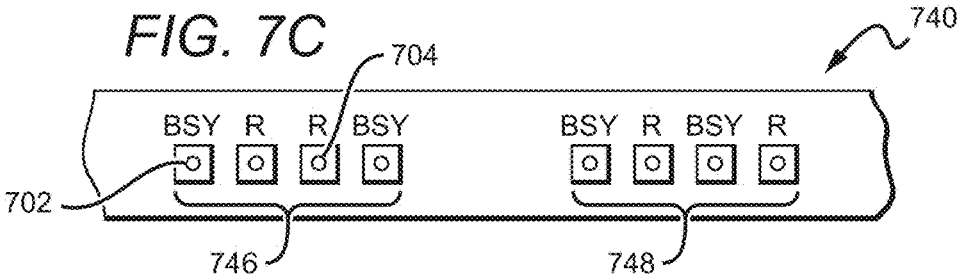

FIG. 9A
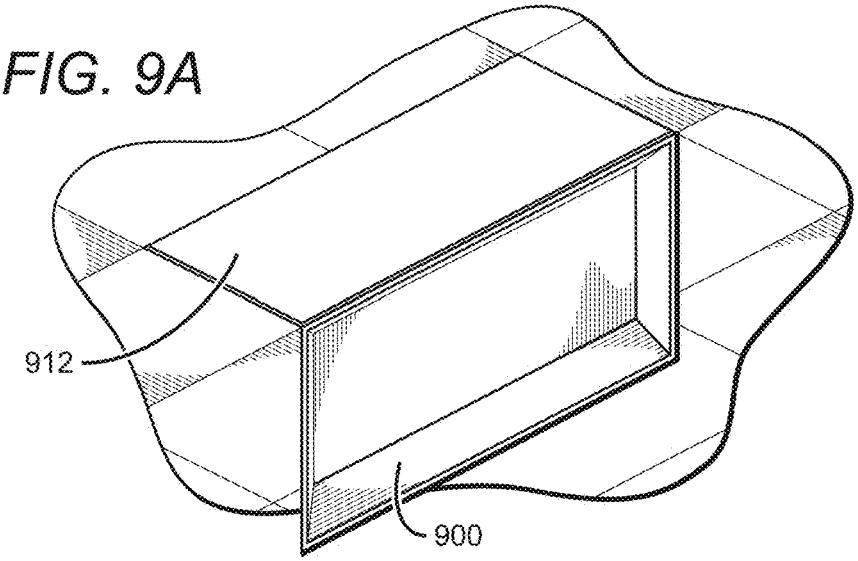
FIG. 9B
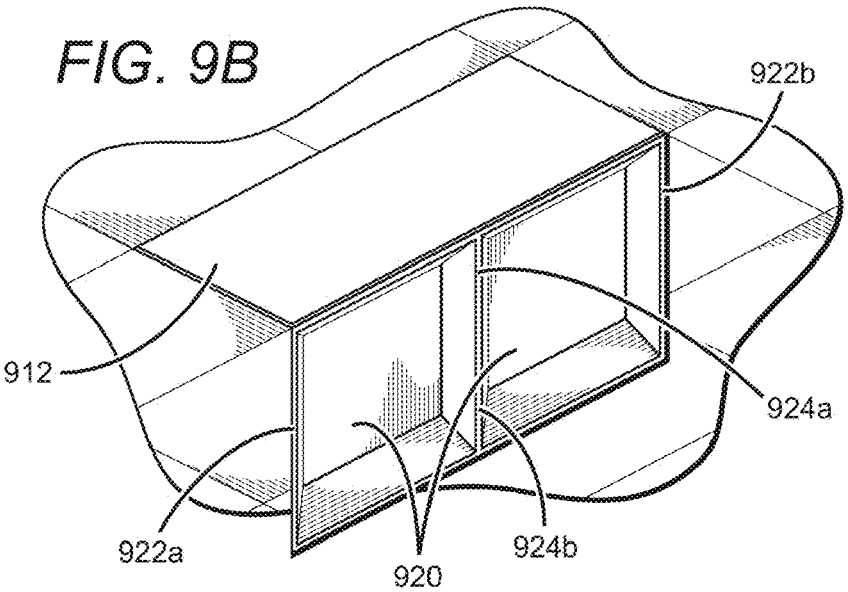
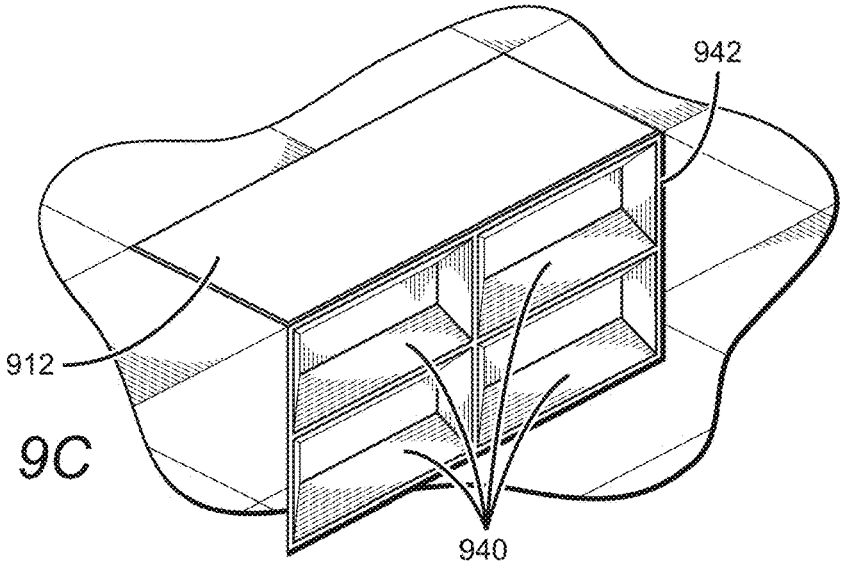
FIG. 9C

Unit Measured
4000k
3 Clusters
Distribution
Correlation is Satisfactory
Type C Gonio Data - 1902
Modeled Distribution - 1904
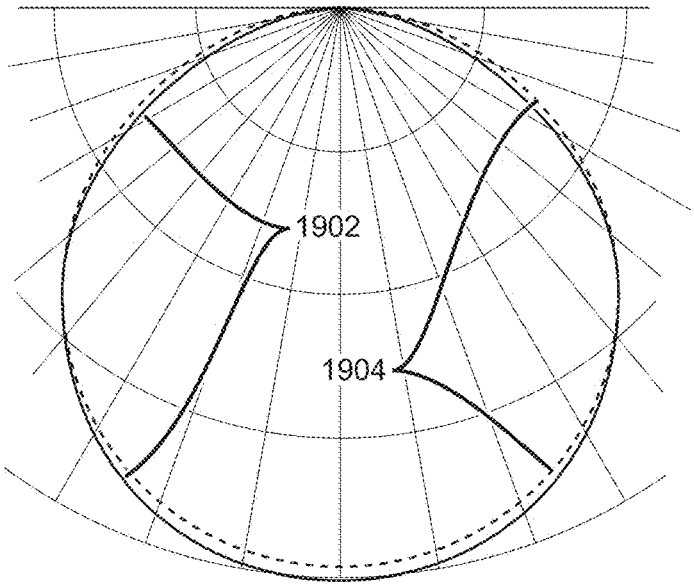
FIG. 19
FIG. 21
Unit Measured
4000k
3 Clusters
Distribution
Very Similar
Reduce High Angle Light
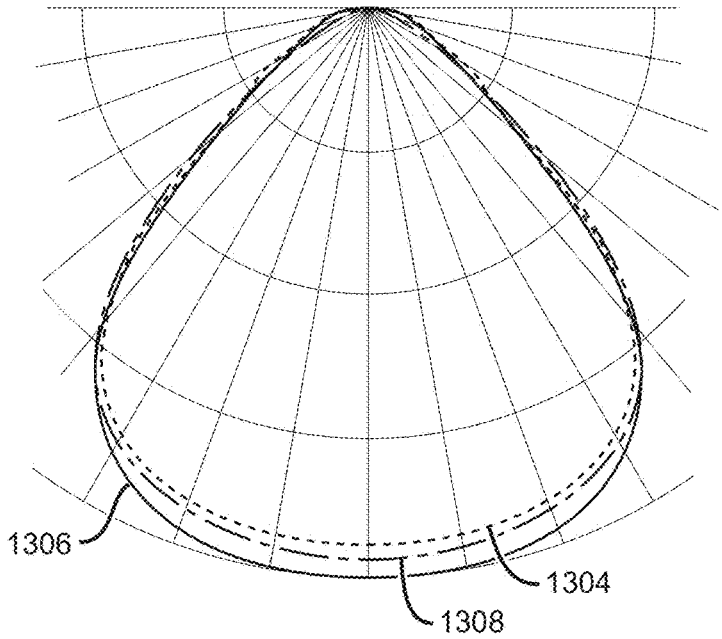
| Lens | % Loss | Lumens | Peak Candela | Number on Chart |
|---|---|---|---|---|
| No Lens | 0 | 2794 | 831 cd | - |
| Conic De-glaring Thick | 7.4% | 2601 | 1165 cd | 1306 |
| Conic De-glaring Thin | 5.8% | 2640 | 1094 cd | 1304 |
| P49 | 10.7% | 2524 | 1126 cd | 1308 |

DOOR FRAME TROFFER

BACKGROUND OF THE INVENTION

Field of the Invention

The invention relates to lighting troffers and, more particularly, to indirect lighting troffers that are well-suited for use with solid state lighting sources, such as light emitting diodes (LEDs).

Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

Door frame troffers are typically mounted to and recessed into a ceiling. A door frame troffer can be installed by attaching one side of the troffer to the ceiling to form a hinge. One or more (in the case of a rectangular troffer, up to three) unhinged sides of the troffer can have attachment mechanisms such as latches. When the troffer is swung about the hinged side into a closed position, the latches can secure the troffer to the ceiling. Troffers that are installed in this manner often include a housing such as a metal back box which protrudes into the plenum. Troffers can also sometimes be installed as retrofit systems to work with components already present in a building, such as a metal back box or a back box used with a fluorescent troffer. Door frame troffers are discussed generally in U.S. Pat. No. 8,038,318 to Plunk.

More recently, with the advent of the efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a printed circuit board (PCB), substrate or submount. The array of LED packages can comprise groups of LED packages emitting different colors, and specular or other reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Many different types and designs of indirect fixtures are possible, as shown by U.S. Pat. No. 7,722,220 to Van de Ven and U.S. patent application Ser. No. 12/873,303 to Edmond, et al. and entitled "Troffer-Style Fixture," both of which are commonly assigned with the present invention and fully incorporated by reference herein. One challenge in designing all fixtures, and particularly indirect lighting fixtures, is to create a large luminous area. For instance, some of the troffers described in U.S. patent application Ser. No. 12/873,303 have a luminous area defined by the dimensions of the light engine, which is relatively small compared to the area of the troffer as a whole. The mixing chamber of such a troffer is also defined by the dimensions of the light engine. Typically a larger mixing chamber results in a more uniform emission.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

One embodiment of a troffer comprises a housing with a door frame, a back reflector, and at least one light bar comprising a mount surface. The mount surface is capable of having at least one light emitter mounted thereto. The region between the at least one light bar and the back reflector defines a mixing chamber.

One embodiment of a troffer comprises a door frame with a back reflector and at least one light bar mounted thereto. The light bar comprises a mount surface. The region between the light bar and the back reflector defines a mixing chamber.

One method of assembling an indirect lighting troffer comprises the following steps. First, an inner surface of an original housing is coated with a reflective material. Then a first side of a door frame is mounted to a first side of the original housing to form a hinge. A second side of the door frame is connected to a second side of the original housing. At least one light bar comprising an emitter is mounted to the door frame.

BRIEF DESCRIPTION OF THE DRAWINGS

FIG. 1 is a perspective cut-away view of a troffer according to an embodiment of the present invention.

FIGS. 2A-2E are perspective views of troffers according to embodiments of the present invention comprising different light bar layouts.

FIGS. 3A and 3B are bottom views of a prior art troffer and a troffer according to an embodiment of the present invention.

FIGS. 5A-5C are magnified views of lenses according to embodiments of the present invention.

FIGS. 6A-6E are cross-sectional views of light bars according to embodiments of the present invention.

FIGS. 7A-7C are top views of light strips comprising emitter clusters according to embodiments of the present invention.

FIGS. 9A-9C are perspective views of troffers according to embodiments of the present invention.

FIG. 19 is a polar intensity distribution graph of a modeled troffer and a troffer according to one embodiment of the present invention.

FIG. 21 is a polar intensity distribution graph of three of the troffers shown in FIG. 13.

DETAILED DESCRIPTION OF THE INVENTION

Figure 4A:
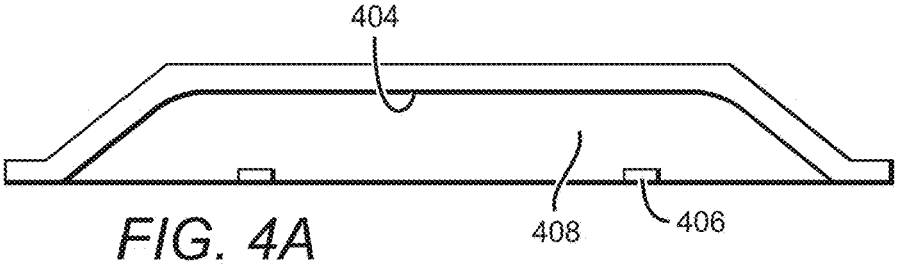
FIGS. 4A-4F are cross-sectional views of troffers according to embodiments of the present invention comprising different reflector shapes.

Embodiments of the present invention provide a troffer-style fixture that is particularly well-suited for use with emitters such as solid state light sources, and in particular light emitting diodes (LEDs). The troffer can comprise a door frame with light bars running therebetween. The light bars can comprise mount surfaces with emitters mounted thereon. The light bars themselves can also serve as heat sinks, and a portion of the heat sink can be exposed to the ambient environment below the ceiling plane. A back reflector defines a reflective surface of the troffer. In some embodiments, one or more lens plates can be secured within the perimeter of the door frame. The interior cavity of the troffer between the reflector and the area defined by the door frame serves as a mixing chamber for the troffer where light can be mixed and/or shaped before it is emitted. Lens plates, if present, can help to further mix and/or shape the emitted light.

Because LED sources are relatively intense when compared to other light sources, they can create an uncomfortable working environment if not properly diffused. Fluorescent lamps using T8 bulbs typically have a surface luminance of around 21 lm/in$^2$. Many high output LED fixtures currently have a surface luminance of around 32 lm/in$^2$. Some embodiments of the present invention are designed to provide a surface luminance of not more than approximately 32 lm/in$^2$. Other embodiments are designed to provide a surface luminance of not more than approximately 21 lm/in$^2$. Still other embodiments are designed to provide a surface luminance of not more than approximately 12 lm/in$^2$. Some embodiments are designed to have a max/min ratio of less than about 3.5. Other embodiments are designed to have a max/min ration of less than about 3.

Some fluorescent fixtures have a depth of 6 in., although in many modern applications the fixture depth has been reduced to around 5 in. In order to fit into a maximum number of existing ceiling designs, some embodiments of the present invention are designed to have a fixture depth of 5 in or less.

Embodiments of the present invention are designed to efficiently produce a visually pleasing output. Some embodiments are designed to emit with an efficacy of no less than approximately 65 lm/W. Other embodiments are designed to have a luminous efficacy of no less than approximately 76 lm/W. Still other embodiments are designed to have a luminous efficacy of no less than approximately 90 lm/W.

One embodiment of a fixture for installation into a ceiling space is designed such that at least 75% of the visible surface of the fixture is luminous. Other embodiments are designed such that at least 90% of the visible surface is luminous. Still other embodiments are designed such that at least 95% of the visible surface is luminous.

One embodiment of a door frame troffer can be installed as a retrofitting system and replace, for example, fluorescent components. After removing fluorescent components, a housing may or may not still be present, such as above the ceiling plane and into the plenum of a building. If a housing is still present, then the housing can be coated or painted with an appropriate reflective material. The door frame troffer without a housing can then be installed and use the coated or painted housing as a back reflector. If a housing is not present, then a troffer comprising a housing can be installed.

Door frame troffers can also be installed using a hinge-and-latch method. One side of the troffer can be attached to a section of ceiling to form a hinge. The body of the troffer can then be swung such that the door frame is flush with the ceiling plane, and latches on one or more of the unhinged sides can then be connected to the ceiling to secure the door frame troffer.

Embodiments of the present invention are described herein with reference to conversion materials, wavelength conversion materials, phosphors, phosphor layers and related terms. The use of these terms should not be construed as limiting. It is understood that the use of the term phosphor, or phosphor layers is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

FIG. 1 is a perspective cut-away view of a troffer 100 according to an embodiment of the present invention. The troffer 100 comprises a door frame 102 which can be around the troffer's lower perimeter. The area within the outer edge of the door frame 102 comprises various luminous surfaces. While the troffer 100 is designed to be fit-mounted within a ceiling, other embodiments may be suspended. Further, other embodiments may be fitted within a floor or a wall.

The troffer 100 has a rectangular bottom-side footprint and comprises two light bars 106 which traverse the width of the fixture 100. The light bars 106 can comprise a mount surface, often on their back sides. Emitters such as light emitting diodes (LEDs) can be mounted to these mount surfaces. Light bars are discussed in detail herein. While two light bars 106 are shown in the FIG. 1 embodiment, other embodiments have one or more light bars. In other embodiments sections of the door frame 102 itself, such as those parallel to the light bars 106, those perpendicular to the light bars 106, or a combination thereof can be used as light bars such that the troffer 100 comprises no separate light bars. Some embodiments incorporate a combination of door frame light bars and separate light bars.

The troffer 100 also comprises a reflector 104. The reflector 104 serves to reflect light from the light bars 106 and through the lens plates 108. The area between the door frame 102 and/or the light bars 106 of the troffer 100 and the reflector 104 serves as an interior cavity or light mixing chamber 110. Some embodiments of reflectors are described in detail herein.

The troffer 100 also comprises lens plates 108. These lens plates 108 can occupy the areas within the door frame 102 between sections of the door frame 102 and the light bars 106. Many types of lens plates 108 can be used in the troffer 100. Some embodiments are described in detail herein.

The troffer 100 also comprises a housing 112. The housing 112 is designed to fit within a ceiling. In some cases, a housing may already be present in a ceiling prior to installation. A troffer can then be installed by attaching it to the existing housing, which can save the costs associated with completely replacing a housing. Further, while the troffer 100 comprises a separate reflector 104, in some cases a separate reflector is not needed and the housing 112 itself serves as a reflector. Some embodiments comprise both a separate reflector and a reflective housing.

FIGS. 2A-2E are perspective views of troffers comprising different light bar layouts. FIG. 2A shows a troffer 200 with a light bar layout similar to that of the troffer 100 in FIG. 1. The troffer 200 comprises five light bars 206 which traverse the width of a rectangular door frame 202. In this embodiment, the distance between the door frame 202 and the light bars 206*a* and 206*b*, as well as the distance between each of the light bars 206, is equal. This allows each of the lens plates 208 to have equal dimensions. In some embodiments these distances are not equal, and in some embodiments the lens plates 208 do not have equal dimensions. In various embodiments of the present invention, light bars such as the light bars 206 can serve as structural mechanisms for holding lens plates, such as the lens plates 208, in place.

FIG. 2B shows a troffer 210 comprising two light bars 216. The light bars 216 traverse the length of the rectangular door frame 212. In the embodiment shown, the distance between the sides of the door frame 212 and the light bars 216 is smaller than the distance between the light bars 216*a* and 216*b*. Thus, in the embodiment shown, the lens plates 218*a* have one set of dimensions while the lens plate 218*b* has a different set of dimensions.

FIG. 2C shows another embodiment of a troffer according to the present invention. A troffer 220 comprises a rectangular light bar 226. In the embodiment shown, the rectangular light bar 226 is an offset rectangular light bar, meaning that the dimensions of the light bar 226 are proportional to the dimensions of the rectangular door frame 222. In other embodiments, the dimensions of a rectangular door frame and a rectangular light bar may not be proportional. In the FIG. 2C embodiment, the rectangular light bar 226 is not directly connected to the door frame 222. Due to the shape of the light bar 226, the lens 228 can be divided into two sections, in this case inner and outer sections.

FIG. 2D shows yet another embodiment of a troffer according to the present invention. A troffer 230 comprises two rectangular light bars 236. In the embodiment shown the light bars 236 form a square, although other patterns are possible. Further, other embodiments comprise a single square light bar, while some embodiments comprise three or more rectangular or square light bars. Similar to the rectangular light bar 226 of FIG. 2C, the light bars 236 are not connected directly to the door frame 232. The troffer 230 does not, however, comprise lens plates, and the light bars 236 must therefore be connected to the troffer 230 in another manner. In the FIG. 2D embodiment, attachments 237 connect the light bars 236 to the rest of the troffer 230. In the embodiment shown the attachments 237 connect the light bars 236 and a housing 239. In other embodiments, one or more attachments can connect one or more light bars to one or more reflectors, a housing, a door frame, or various other elements, or can connect light bars to a combination of elements. Further, these attachments can be rigid, or as in the case of the attachments 237 shown in FIG. 2D, can be flexible. One example of a troffer comprising flexible attachments 237 is a troffer comprising cables connected to a reflector from which one or more light bars are suspended.

FIG. 2E shows a troffer 240 that does not comprise separate light bars. Instead, parts of the door frame 242 or the entire door frame 242 can serve as light bars. In some embodiments which do not comprise separate light bars, emitters mounted to the door frame 242 have a directional emission or can be angled so as to emit towards the center of the troffer 240.

While FIGS. 2A-2E show troffers with five different light bar arrangements, many other arrangements are possible. For example, troffers can comprise light bars in a hatched, X-shaped, or cross arrangement. A hatched arrangement is particularly applicable to an embodiment where a high emission intensity is desired. Some embodiments comprise both separate light bars and a door frame that acts as a light bar. Other light bar arrangements are also possible.

FIGS. 3A and 3B show visible surfaces of a known troffer 300 and a troffer 350 according to the present invention from the bottom. The troffer 300 comprises a single mixing chamber 310 behind two lens plates 308 and a light bar 306. While the pan 322 surfaces reflect some of the light out of the troffer 300, the two lens plates constitute the entire luminous surface 320 of the troffer 300.

FIG. 3B shows a bottom view of a troffer 350 according to the present invention. The troffer 350 comprises a square door frame 352, two light bars 356, and three lens plates 358. In this embodiment, the lens plates 358 constitute the luminous surface of the troffer 350. The FIG. 3B embodiment comprises a single mixing chamber 360 behind the light bars 356 and the lens plates 358. The lens plates 358 occupy a much larger area in the troffer 350 than the lens plates 308 in the known troffer 300. Thus, troffers according to embodiments of the present invention such as the troffer 350 utilize much more of the bottom side visible surfaces as luminous surfaces 370. In some embodiments, the majority of a troffer's bottom side visible surfaces are luminous. In other embodiments, 75% or more are luminous. In other embodiments, 90% or more of the bottom side visible surfaces are luminous. In still other embodiments, 95% or more of the bottom side visible surfaces are luminous. In the FIG. 3B embodiment, the only areas of the bottom side visible surface that are not luminous are the door frame 352 and the areas covered by the light bars 356. Troffers with a large percentage of luminous area in the bottom side visible surface can be more visually pleasing to users.

FIGS. 4A-4F show embodiments of troffers comprising different reflectors. Reflector shape and size design will often be driven by mechanical constraints. While each of the troffers shown comprises two light bars 406, other embodiments can comprise a single light bar, three or more light bars, or any of the light bar arrangements described above with regard to FIGS. 2A-2E, and the reflectors can be modified to accommodate additional light bars. The distance from the emitters to the reflector can affect the emission profile of the troffer as a whole. For example, a troffer with a deep reflector placed further from the emitters can have a broader emission profile. In the embodiment shown by FIG. 4A, a troffer 400 comprises an open quadrilateral reflector 404. The reflector 404 has a cross-section that is trapezoidal with rounded top corners, although it can be rectangular with rounded corners or any number of other shapes. The rounded corners of the reflector 404 encourage mixing, while the mixing chamber 408 will have a relatively large volume, which encourages effective mixing and scattering, due in part to the trapezoidal shape of the reflector 404.

Figure 4B:
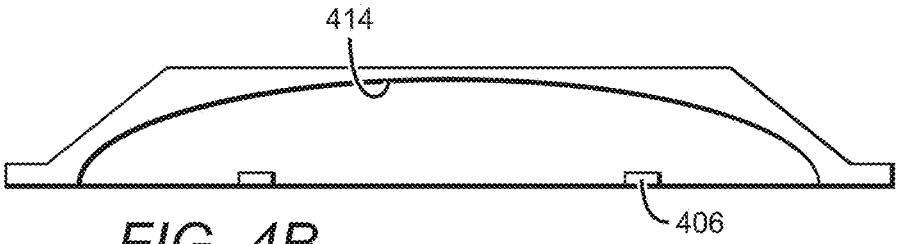
Figure 4C:
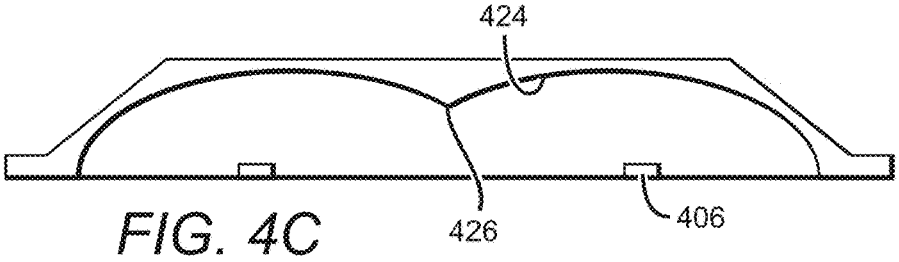
Figure 4D:
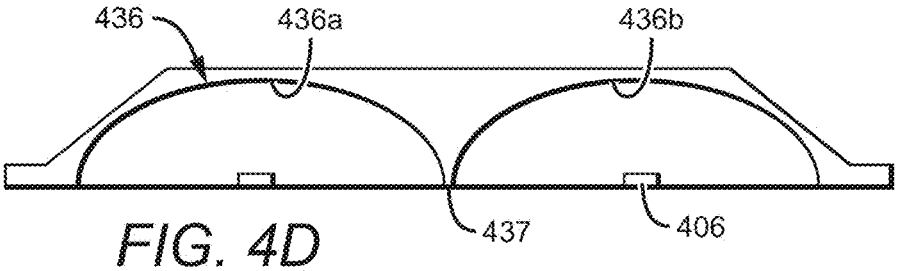

FIG. 4B shows a single reflector 414 with a round cross-section. The reflector 414 fits over all of the light bars 406. FIG. 4C shows a single reflector 424 with two round sections joining at an apex 426. Embodiments with more than two light bars 406 can have a number of apexes 426 that is one less than the number of light bars 406. FIG. 4D shows a reflector system 436 with two separate frustospherical reflector sections 436*a* and 436*b*, each over one of the light bars 406. The sections 436*a* and 436*b* can intersect and be directly connected, or there can be a gap 437 between the two section reflectors.

While the reflector embodiments shown in FIGS. 4A-4D show some of the possible reflector shapes, other reflector shapes are possible. For example, in one embodiment the reflector can be a truncated tetrahedron. Many different reflector shapes are known in the art, and the shapes disclosed herein are not intended to be limiting in any way.

Figure 4E:
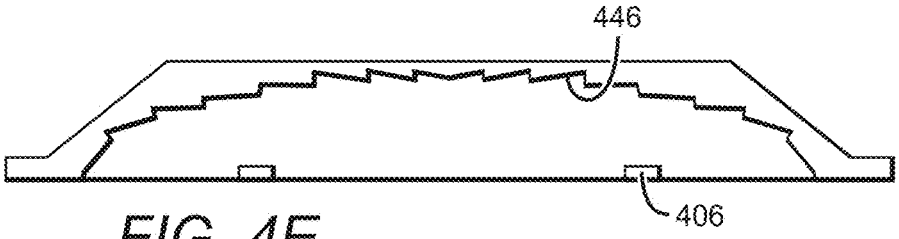

FIG. 4E shows a reflector 446 with a stepped surface. A stepped reflector such as the reflector 446 can take any general shape, such as those described above with regards to FIGS. 4A-4D, but also comprises faceting or rippling. The faceting or rippling can help to hide hotspots (or areas of high intensity reflectance) on a reflector.

Reflectors according to the present invention can comprise many different materials. In one embodiment of the present invention, the reflector comprises a diffuse reflective surface. In some embodiments of the present invention, a reflector can comprise a polymeric or film material designed to reflect light emitted from an emitter on a light bar. In some embodiments the reflector surface can be white. In some embodiments the reflector comprises a white plastic, such as white plastic sheet(s) or one or more layers of microcellular polyethylene terephthalate ("MCPET"), and in some embodiments the reflector comprises white paper. In some embodiments reflector can comprise a white film, such as White97™ Film available from WhiteOptics, LLC, of New Castle, Del. In other embodiments the reflector can comprise metal, including but not limited to WhiteOptics™ Metal, available from WhiteOptics, LLC, or similar materials. In some embodiments, the reflector can be a plastic or metal device that is coated or painted with a reflective material or another base material coated with a reflective material. Materials can also include specular reflectors which can help directly control the angle of redirected light rays, Lambertian reflectors, and combinations of diffuse, specular, and Lambertian reflectors.

Figure 4F:
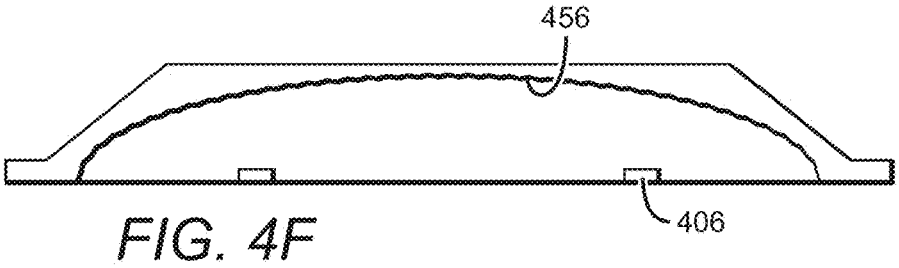

FIG. 4F shows a reflector 456 that has the same general shape as reflector 406 in FIG. 4B, but is textured. The stepped shape of the reflector 446 or the texturing of the reflector 456 can be used with a reflector of any general shape, including but not limited to those described above. Textured reflectors are described in U.S. patent application Ser. No. 13/345,215 to Lu et al. and entitled "Light Fixture with Textured Reflector," which is commonly owned with the present application and fully incorporated by reference herein.

In some embodiments, the texturing can be imparted to the reflector 456 by roughening the interior or exterior surface of the reflector. As in the case of imprinting, polycarbonate can be used. Also as in the case of imprinting, the intensity of the roughening can vary spatially relative to the center of the reflector and/or the positioning of the light source. The roughening can be accomplished in a number of different ways, regardless of whether the reflector is initially made by extrusion or by some other method.

The textured reflector 456 can provide color mixing and reduce color hot spots and reflections in a light fixture that uses multiple color emitters. As an example some fixtures include blue-shifted yellow plus red (BSY+R) LED systems, wherein the LED light source includes at least two groups of LEDs, wherein one group emits light having a dominant wavelength from 435 to 490 nm, and another group emits light having a dominant wavelength from 600 to 640 nm. In such a case, one group can be packaged with a phosphor, which, when excited, emits light having a dominant wavelength from 540 to 585 nm. In some embodiments, the first group emits light having a dominant wavelength from 440 to 480 nm, the second group emits light having a dominant wavelength from 605 to 630 nm, and the troffer emits light having a dominant wavelength from 560 to 580 nm.

As just one example of a textured reflector according to embodiments of the invention, thin extruded high reflectivity PC plates can have a pattern imprinted as part of the extrusion process, and the plates can be pressed onto an un-textured extruded PC back reflector substrate. One example of an imprinted pattern is a prismatic pattern, which can include repeated prismatic elements extending in all directions. Such a pattern can also be used in a lens material. Another example of an imprinted pattern is a cut keystone pattern. Alternatively, the entire reflector can be extruded with an imprinted pattern on the inside or bottom surface of the reflector. Either type of imprinting can be accomplished with a textured drum as part of the extrusion process. A roughening pattern can also be applied by roughening a reflector or a plate to be pressed on to a reflector substrate with sand blasting, sanding, or another roughening technology.

Some embodiments of troffers according to the present invention comprise one or lenses or lens plates. Lens plates can serve to provide physical protection to components within the troffer, such as LEDs. Lens plates can achieve this by, for example, preventing physical damage or dust accumulation, which can negatively affect the troffer's emission efficiency, intensity, and/or profile. Lens plates also serve to improve the uniformity of the troffer emission. Depending upon the type of emitters and the reflector used in a troffer, bright "hotspots" of light can sometimes be seen on the reflector above the emitter sources. These hotspots are sometimes undesirable and can negatively affect emission uniformity. Lens plates can help to reduce the appearance of these hotspots to a viewer by spreading the Light reflected from these hotspots across a wider viewing area. In some cases the light reflected from these hotspots can be spread across the entire luminaire. Even in troffers wherein no hotspots or insubstantial hotspots are formed, lens plates can help to diffuse light, broaden the troffer's emission profile, focus the troffer's emission profile, and/or create a more uniform appearance.

In one embodiment, the lens plate are faceted. Faceted lenses can use bumps or pips to scatter light in a predictable manner. Close-up views of faceted lens plates according to the present invention are shown in FIGS. 5A-5C. FIG. 5A shows a faceted lens 500 comprising deglaring prisms 502. The deglaring prisms 502 can be in a repeating prism pattern to, among other functions, help mix light. The prisms 502 can improve uniformity while maintaining high optical transmission. The lens plate 500 can reduce the amount of light emitted at high angles and reduce glare, sometimes such that the emission is glare free. The prisms 502 can be formed in multiple manners, including by rolling and hot embossing, for example.

FIG. 5B shows a faceted lens 510 comprising linear prisms 512. Prism 512 can run in straight lines or twist across the face of the lens to provide various optical appearances. The lens 510 can comprise linear prisms 512 on the emission side of the lens plate 510, the troffer side of the lens plate, or both.

FIG. 5C shows a faceted lens 520 comprising a film 522. The thin film 522 has linear or discrete facets that allow for a reduction in material volume. The film 522 can be used to create various optical effects. These effects are amplified if a plurality of films 522 are stacked upon one another. The lens plate 520 can comprise films 522 on the emission side of the lens plate 520, the troffer side of the lens plate 520, or both. Lenses that themselves comprise texturing and lenses that comprise films such as the film 522 are discussed further below with regard to FIGS. 11-21.

One embodiment of a lens plate used in a troffer according to the present invention comprises extruded acrylic with either a diffuser built into the acrylic or a diffuser film coating. Other embodiments of lens plates that can be used in the present invention include diffuse lenses, which scatter all incident light. Further embodiments can comprise acrylics, PMMAs, and/or diffusing additives. Some embodiments can comprise clear acrylics. The types of lens plates described herein are only a few of the types of lenses that can be used, and are in no way intended to be limiting. Lenses and methods that can be used in embodiments of troffers incorporating elements of the present invention are described in detail in U.S. patent application Ser. No. 13/442,311 to Lu et al. and filed Apr. 9, 2012, which is commonly assigned with the present application and incorporated by reference herein in its entirety.

While embodiments of troffers according to the present invention comprising lens plates have been described above, some troffers according to the present invention do not comprise lenses. A combination of other components of the troffer, such as emitters and reflectors, may be used to achieve an effect similar to that of a lens. One embodiment of a troffer according to the present invention that does not comprise a lens comprises louvers. A troffer comprising louvers can comprise separate light bars, such as light bars above the louvers. Alternatively, the louvers actually serve as the light bars and have emitters mounted thereon. Louvers can be both functional louvers serving as heat sinks and with emitters mounted thereon, optical louvers designed to diffuse light, or both. Fixtures and troffers comprising louvers are described in detail in U.S. patent application Ser. No. 13/453,924 to Pickard et al. and entitled "Parabolic Troffer-Style Light Fixture," which is commonly assigned with the present application and is fully incorporated by reference herein. Embodiments without a lens can provide a low cost alternative to embodiments with lens plates.

FIG. 6A shows a cross-sectional view of a light bar according to the present invention. The light bar 600 comprises a heat sink portion 602, a mount surface 604, two connection areas 606, fins 608, and a light strip 610 with one or more emitters 612 mounted thereon. In the embodiment shown, the light bar 600 is held in place through a connection between the lens plates 614 and the connection areas 606, although other light bar mounting methods are possible. It is understood that many different light bar structures and heat sink structures can be used. The top side portion of the heat sink 602, which can face the interior of a mixing chamber such as the mixing chamber 110 of FIG. 1, comprises the mount surface 604. In the embodiment shown the mount surface 604 is recessed into the rest of the body of the heat sink 602, which can help secure the light strip 610. In other embodiments, a mount surface is not recessed. In some embodiments the emitter 612 can be mounted directly to the heat sink 602 instead of to a light strip such as the light strip 610. The connection areas 606 provide an area wherein a lens plate 614 can fit securely, which can help secure the light bar 600.

A typical solid state light fixture will incorporate a heat sink that sits above the ceiling plane to dissipate conducted LED heat into the environment. Temperatures above office and industrial ceilings in a non-plenum ceiling regularly reach 35° C. As best shown in FIG. 1, discussed herein, the bottom portion the light bar 106, which can comprise a heat sink such as the heat sink 602, is exposed to the air in the room beneath the troffer.

A light bar with an exposed heat sink such as the heat sink 602 is advantageous for several reasons. For example, air temperature in a typical office room is much cooler than the air above the ceiling, obviously because the room environment must be comfortable for occupants; whereas in the space above the ceiling, cooler air temperatures are much less important. Additionally, room air is normally circulated, either by occupants moving through the room or by air conditioning. The movement of air throughout the room helps to break the boundary layer, facilitating thermal dissipation from the heat sink 602. Also, a room-side heat sink configuration prevents improper installation of insulation on top of the heat sink as is possible with typical solid state lighting applications in which the heat sink is disposed on the ceiling-side. This guard against improper installation can eliminate a potential fire hazard.

FIGS. 6B-6E show alternative heat sink designs to that shown in FIG. 6A. The heat sink 640, shown in FIG. 6B, has a smaller height while maintaining the double-fin design of the heat sink 600. The heat sink 640, shown in FIG. 6C, comprises only a single fin set 648. Heat sinks similar to those described in U.S. patent application Ser. No. 12/873,303 to Edmond et al. and entitled "Troffer-Style Fixture," commonly assigned with the present application and fully incorporated by reference herein, are also possible. FIG. 6D shows a heat sink 660 comprising fins 668 and two connection areas 666 for holding lens plates 674. FIG. 6E shows a heat sink 680 comprising fins 688 and two connection areas 686 for holding lens plates 694. As shown in FIG. 6E, light bars according to the present invention can have more than one mounting area. The heat sink 680 comprises two mounting areas 684*a*, 684*b*, whereon multiple light strips comprising emitters can be placed. These mounting areas 684*a*, 684*b* can be designed to hold emitters that emit at different angles and/or use additional reflectors to help produce the desired troffer emission profile.

While the light bars and heat sinks discussed above comprise connection areas in which a lens plate can fix, some embodiments of troffers according to the present invention do not comprise these connection areas. Instead, one or more light bars can be attached to the bottom surface of a lens plate using a variety of methods. In such a troffer, it is possible to reduce the number of lens plate and in some cases have only a single lens plate.

Many different types of emitters can be used in embodiments of the present invention. In some embodiments the emitters are solid state emitters such as LEDs or LED packages. Many different LEDs can be used such as those commercially available from Cree Inc., under its DA, EZ, GaN, MB, RT, TR, UT and XT families of LED chips.

Further, many different types of LED packages can be used in embodiments of the present invention. Some types of chips and packages are generally described in U.S. patent application Ser. No. 12/463,709 to Donofrio et al., entitled "Semiconductor Light Emitting Diodes Having Reflective Structures and Methods of Fabricating Same," U.S. patent application Ser. No. 13/649,052 to Lowes et al., entitled "LED Package with Encapsulant Having Planar Surfaces," and U.S. patent application Ser. No. 13/649,067 to Lowes et al., entitled "LED Package with Multiple Element Light Source and Encapsulant Having Planar Surfaces," all of which are commonly assigned with the present application and all of which are fully incorporated by reference herein in their entirety. The emitters can emit many different colors of light, with some emitters emitting white light (or chips emitting blue light, part of which is converted to yellow light to form a white light combination). One embodiment of a package that can be used in a lamp according to the present invention comprises a substantially box shaped encapsulant, which results in a package emission that is broader than Lambertian. Many of these packages are shown and described in U.S. patent application Ser. No. 13/649,067 to Lowes et al. It is understood that in some embodiments the LED can be provided following removal of its growth substrate. In other embodiment, the LED's growth substrate can remain on the LED, with some of these embodiments having a shaped or textured growth substrate. In some embodiments when the LED's growth substrate remains on the LED, the LED is flip-chip mounted onto a light strip or mount surface.

In some embodiments, the LEDs can comprise a transparent growth substrate such as silicon carbide, sapphire, GaN, GaP, etc. The LED chips can also comprise a three dimensional structure and in some embodiments, the LEDs can have structure comprising entirely or partially oblique facets on one or more surfaces of the chip.

In one embodiment, at least some of the emitters are LED chips and/or packages which can, in some embodiments, have an emission pattern that is broader than Lambertian, such as, for example, those described in U.S. patent application Ser. Nos. 13/649,052 and 13/649,067. In another embodiment, these LED chips and/or packages are used in combination with standard Lambertian emitters. In another embodiment, the emitters are phosphor-coated LEDs such as, for example, those described in U.S. patent application Ser. Nos. 11/656,759 and 11/899,790, both to Chitnis et al. and both entitled "Wafer Level Phosphor Coating Method and Devices Fabricated Utilizing Method," both of which are commonly assigned with the present application and both of which are fully incorporated by reference herein. In one embodiment the emitters these aspects and are phosphor-coated LED chips and/or packages with emission patterns that are broader than Lambertian. In another embodiment, these LEDs emit in the blue spectrum and are covered in a yellow phosphor, resulting in a white emission. In another embodiment the emitters have a Lambertian emission profile.

The mount surface 604 provides a substantially flat area on which one or more light sources 612 can be mounted. In some embodiments, the light sources 612 will be pre-mounted on the light strips 610. FIGS. 7A-7C show a top plan view of portions of several light strips 700, 720, 740 that may be used to mount multiple LEDs to the mount surface 604. In one embodiment not shown in FIGS. 7A-7C, all of the emitters are the same type of solid state emitter, for example, LED packages emitting white light or phosphor coated LEDs that emit a blue/yellow combination of white light. In a embodiment comprising all emitters of the same type, the emitters are equally spaced apart from one another.

In another embodiment, the emitters emit different types of light. In one such embodiment, some of the emitters are BSY (blue shifted yellow) LEDs while the rest are red LEDs, resulting in a warm white lamp emission. Some such embodiments are shown in FIGS. 7A-7C. FIGS. 7A-7C show light strips 700, 720, and 740, each comprising BSY LEDs 702 and red LEDs 704.

In the FIG. 7A embodiment, the emitters are in clusters 706 comprising a BSY emitter 702, a red emitter 704, and another BSY emitter 702. The FIG. 7B embodiment comprises alternating four emitter clusters 726 and 728. The first cluster 726 comprises two BSY emitters 702, a red emitter 704, and a single BSY emitter 702. The next cluster 728 is the mirror image of the cluster 726, and the clusters alternate on the light strip 720. The light strip 720 will have a slightly cooler emission than the light strip 700. In the FIG. 8A embodiment, the light strip 740 comprises four emitter clusters 746 and 748. The first cluster 746 comprises in order a BSY emitter 702, two red emitters 704, and a BSY emitter 702. The second cluster 748 comprises alternating BSY and red emitters. A single light strip can contain repeating clusters of either type, or a combination thereof. One embodiment of a light strip comprises three LED clusters. Another embodiment of a light strip comprises four LED clusters. In another embodiment, a light strip comprises ten LED clusters per foot. In yet other embodiments, a light strip comprises five clusters per foot or twenty clusters per foot or more.

Further, in some embodiments clusters may not be evenly distributed along a light bar. For example, a troffer according to the present invention can comprise a concentrated area of emitters, such as where light bars intersect. Examples of concentrated areas of emitters are described in U.S. patent application Ser. No. 13/429,080 to Edmond et al. and entitled "Modular Indirect Troffer," which is commonly assigned with the present application and fully incorporated by reference herein.

Embodiments of troffers according to the present invention can comprise remote phosphors which convert some of emitted light to a different color. A remote phosphor could be placed, for example, over the light bars or coated onto the reflector. Troffers comprising a remote phosphor are described in U.S. patent application Ser. No. 13/088,690 to Medendorp et al. and entitled "LED Luminaire Including a Thin Phosphor Layer Applied to a Remote Reflector," which is commonly assigned with the present application and fully incorporated by reference herein.

Various combinations of colors can be used for both the color emitted by the LED packages and the color emitted by the phosphor. As one example, blue-shifted yellow (BSY) LED devices can be used as the light source, and red-emitting phosphor can be used on the reflector. For example, in some embodiments, the phosphor layer on the reflector, when energized, emits light having dominant wavelength from 600 to 640 nm, or 605 to 630 nm, which in either case may be referred to as "red" light. The LEDs in the BSY LED packages that serve as the light source, when illuminated, emit light having a dominant wavelength from 435 to 490 nm, 440 to 480 nm, or 445 to 465 nm. The phosphor in the BSY LED packages emits light having a dominant wavelength from 540 to 585 nm, or 560 to 580 nm. These combinations of lighting elements can be referred to as a "blue-shifted yellow plus red" (BSY+R) system. This is but one example of a combination of lighting elements and phosphor that can be used to create substantially White light with a color rendering index (CRI) at least as good as generated by relatively loW CRI types of residential lighting. Embodiments of the invention can produce light with a CRI of at least 70, at least 80, at least 90, or at least 95. Further examples and details of mixing colors of light using solid state emitters and phosphor can be found in U.S. Pat. No. 7,213,940 to Van de Ven et al. and entitled "Lighting Device and Lighting Method," which is commonly assigned with the present application and fully incorporated by reference herein.

Figure 8:
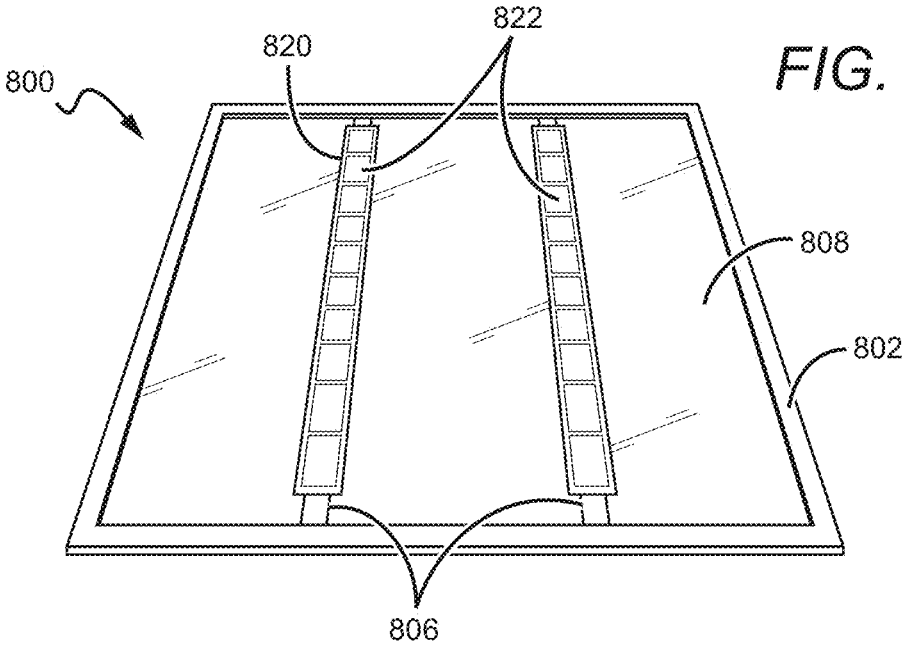
FIG. 8 is a back view of a troffer according to an embodiment of the present invention with the housing and reflector removed.

FIG. 8 shows one embodiment of a troffer 800 according to the present invention without showing the housing and reflector for viewing purposes. Shown in FIG. 8 are a door frame 802, two light bars 806, and three lens plates 808. Mounted on the light bars 806 are light strips 820; mounted on each of the light strips 820 are emitter arrays 822. Embodiments of the present invention can comprise various types of emitter arrays, including but not limited to arrays of all the same emitter type and/or arrays similar to or the same as 706, 726, 728, 746, 748 described above.

FIGS. 9A-9C show different combinations of troffers according to the present invention that can be used to form a light fixture. In all three embodiments a 2' by 4' light fixture is desired, although these dimensions are only exemplary and in no way limiting. In FIG. 9A, a single troffer 900 is attached to a housing 912 designed for a 2' by 4' troffer.

Alternatively, FIG. 9B shows an embodiment where two 2' by 2' troffers 920 are combined to fit within the same housing 912. In some embodiments, the door frames 922 can be designed such that one or more sides of the door frames 922 can attach to a side of a second door frame. In the embodiment shown, the side 924*a* of the door frame 922*a* is designed to connect with the side 924*b* of the door frame 922*b*. In other embodiments, a secure connection between door frame sides is not made. Instead, the door frames are properly supported by the door frame sides which are connected to a housing.

FIG. 9C shows an embodiment where four 1' by 2' troffers 940 are combined to fit within the same housing 912. The sides of the door frames 942 can attach in a manner similar to the door frame sides 924. In the embodiment shown, each door frame 942 can have two or more connectable sides.

Embodiments like those shown in FIGS. 9B and 9C enable a user to order only one size of troffer and use a single size of troffer to fit fixtures of different sizes. Further any output loss associated with using multiple troffers is minimized, since only the area of the door frame sides placed within the housing perimeter detract from the luminous area. Troffers that do not have separate reflectors can also be utilized in embodiments similar to those of FIGS. 9B and 9C. For example, if internal surface of the housing 912 is coated with a reflective material, then multiple troffers similar to the troffers 920, 940 without reflectors can all use the same housing surface as a mutual reflector.

Figure 10A:
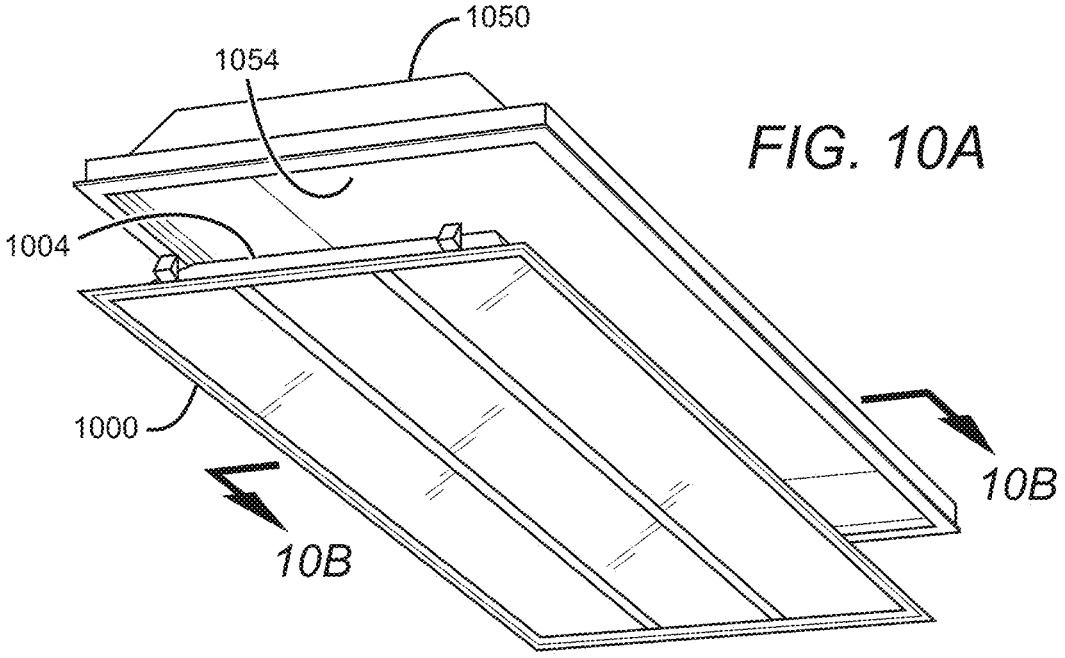
FIGS. 10A and 10B are an exploded perspective and a perspective view of a troffer according to an embodiment of the present invention.

Some troffers according to the present invention comprise a housing or metal back box prior to installation. Alternatively, some embodiments of troffers according to the present invention can be used to retrofit old lighting fixtures. For example, FIG. 10A shows a troffer 1000 and a housing 1050. The housing 1050 is a version of a typical housing found in many commercial offices and industrial spaces and built to house fluorescent tubes to provide light.

To retrofit such a fluorescent fixture, the fluorescent tubes and other components can be removed. The troffer 1000 can then be installed and replace these components to provide better and more economical lighting. Emitter leads, such as LED leads, can be installed and bypass any remaining fluorescent electronics. The troffer 1000 can comprise a reflector 1004, as shown. In other embodiments, the troffer 1000 does not comprise a separate reflector. Instead, the inner surface 1054 of the housing 1050 is coated with a reflective material before the troffer 1000 is installed. The inner surface 1054 of the housing 1050 can then serve as a reflector.

Figure 10B:
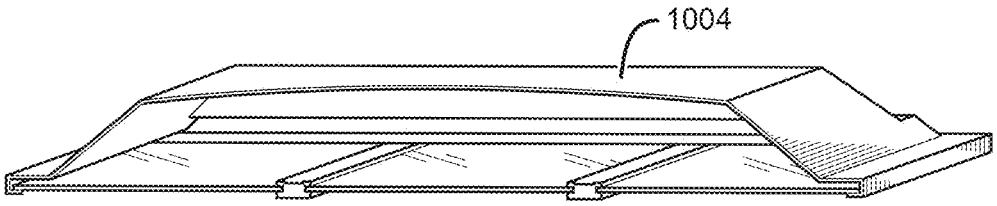

FIG. 10B shows the troffer 1000 fully installed in the housing 1050. Installation of a retrofit troffer such as the troffer 1000 can be completed in many ways, including a hinge-and-latch method. In one embodiment, after at least some old lighting elements and/or associated parts are removed, a door frame is attached to the edges of an original pan or a ceiling such as, for example, by attaching one side of the door frame to one edge of the pan or ceiling and using that edge as a hinge to swing the remainder of the troffer into place (e.g., in one embodiment, flush with the ceiling plane) for attachment. Light bars can then be attached to the door frame, such as through a snap connection with the door frame. One or more lenses, if present, can be slid into slots on the light bars to complete installation. In another embodiment, the door frame, light bars, and one or more lenses (if present) are installed as a single piece using the hinge-and-swing method described above. In a final embodiment, all sides of the door frame are connected to an original pan or ceiling through unhinged attachment means, such as snap connections. The above retrofit kits and methods can also include a back reflector, which can be a separate element, an element of a one-piece retrofit kit, or a coating to be applied to an original pan, for example.

In some instances, such as retrofitting an incandescent door frame troffer, a usable door frame may already be in place, in which case light bars could be snapped into place on the door frame in a desired light bar pattern. If lenses were desired, lenses could then be attached to these light bars. Retrofit kits and installation methods such as those described above can be especially useful to users who desire troffers with custom door frame dimensions and/or light bar lengths, as a user can simply order a door frame, light bars, and/or lenses to fit any space within a ceiling. Elements of retrofit light fixtures that can be incorporated into embodiments of the present invention are described in U.S. patent application Ser. No. 13/672,592 to Dixon and entitled "Recessed Light Fixture Retrofit Kit," commonly assigned with the present application and incorporated by reference herein in its entirety.

Figure 11:
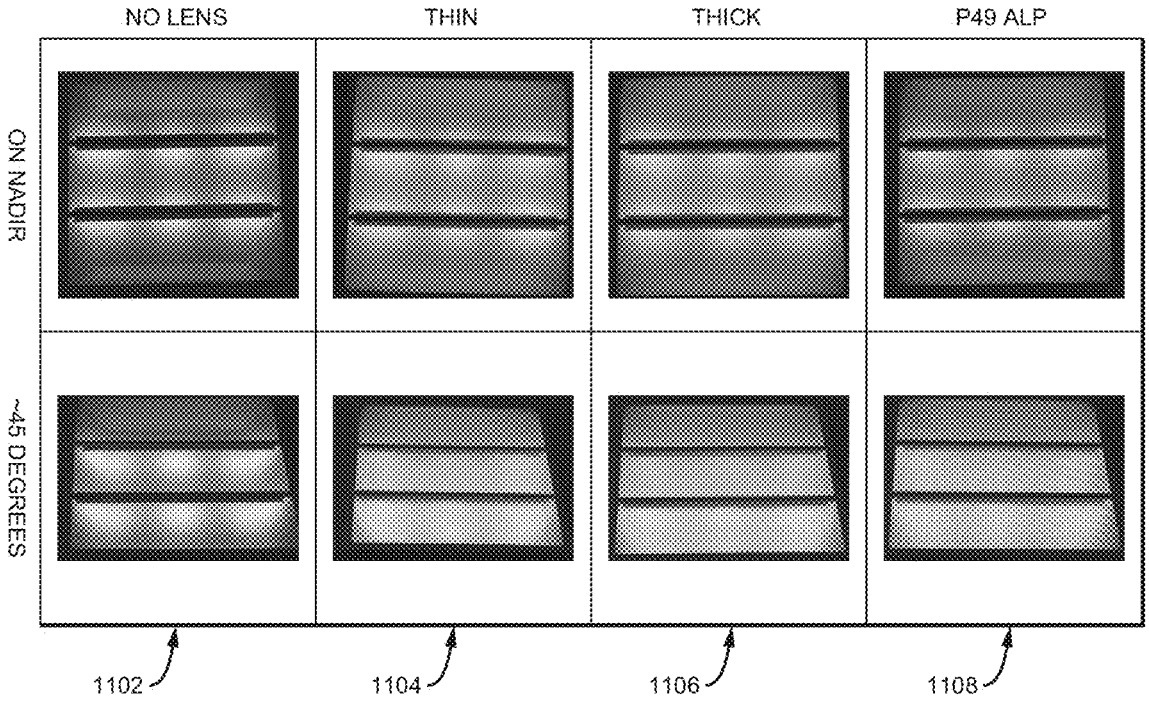
FIG. 11 is a nadir view and a 45° off-nadir view of four troffers according to embodiments of the present invention.

FIG. 11 is a compilation of nadir and 45° off-nadir views of four different troffers according to the present invention. Each of the troffers 1102, 1104, 1106, 1108 comprises two light bars, each with three emitter clusters. The troffer 1102 does not comprise a lens. The troffer 1104 and the troffer 1106 comprise lenses incorporating a thin and thick film respectively, such as thin and thick versions of the film 522 in FIG. 5C. The troffer 1108 comprises a P49 male conical prismatic acrylic lens available from A.L.P. Lighting Components, Inc. and similar in some respects to the lenses 500 and 510 in FIGS. 5A and 5B, respectively. The troffers 1102, 1104, 1106, 1108 emit at approximately 3500K.

Figure 12:
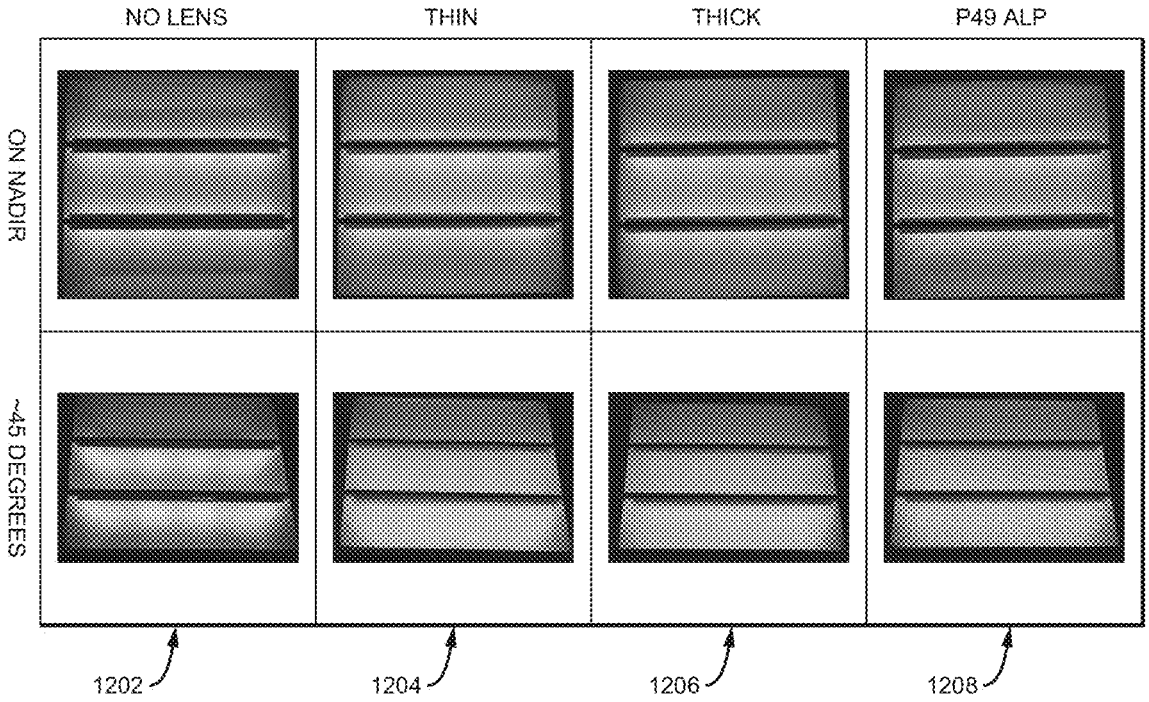
FIG. 12 is a nadir view and a 45° off-nadir view of four troffers according to embodiments of the present invention.

FIG. 12 is a compilation of nadir and 45° off-nadir views of four different troffers according to the present invention. Each of the troffers 1202, 1204, 1206, 1208 comprises two light bars, each with four emitter clusters. The troffer 1202 does not comprise a lens. The troffer 1204 and the troffer 1206 comprise lenses incorporating a thin and thick film respectively, such as thin and thick versions of the film 522 in FIG. 5C. The troffer 1108 comprises a P49 male conical prismatic acrylic lens available from A.L.P. Lighting Components, Inc. and similar in some respects to the lenses 500 and 510 in FIGS. 5A and 58B, respectively. The troffers 1202, 1204, 1206, 1208 emit at approximately 3500K.

Figure 13:
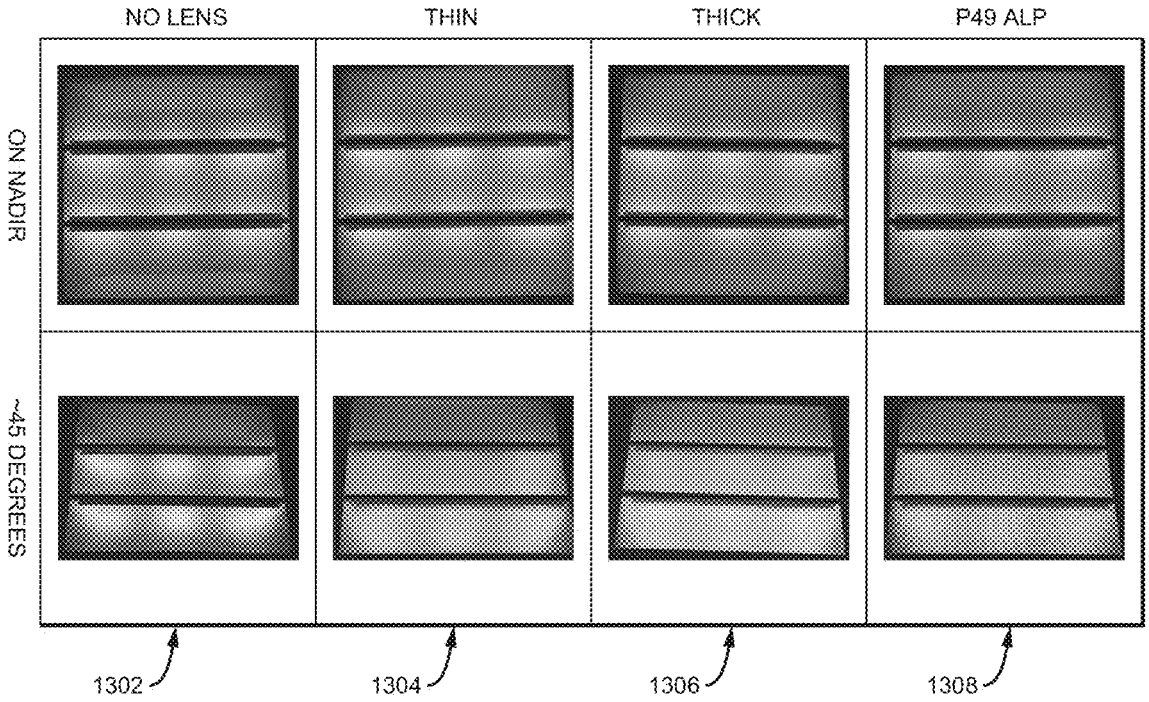
FIG. 13 is a nadir view and a 45° off-nadir view of four troffers according to embodiments of the present invention.

FIG. 13 is a compilation of nadir and 45° off-nadir views of four different troffers according to the present invention. Each of the troffers 1302, 1304, 1306, 1308 comprises two light bars, each with three emitter clusters. The troffer 1302 does not comprise a lens. The troffer 1304 and the troffer 1306 comprise lenses incorporating a thin and thick film respectively, such as thin and thick versions of the film 522 in FIG. 5C. The troffer 1308 comprises a P49 male conical prismatic acrylic lens available from A.L.P. Lighting Components, Inc. and similar in some respects to the lenses 500 and 510 in FIGS. 5A and 5B, respectively. The troffers 1302, 1304, 1306, 1308 emit at approximately 4000K.

Figure 14:
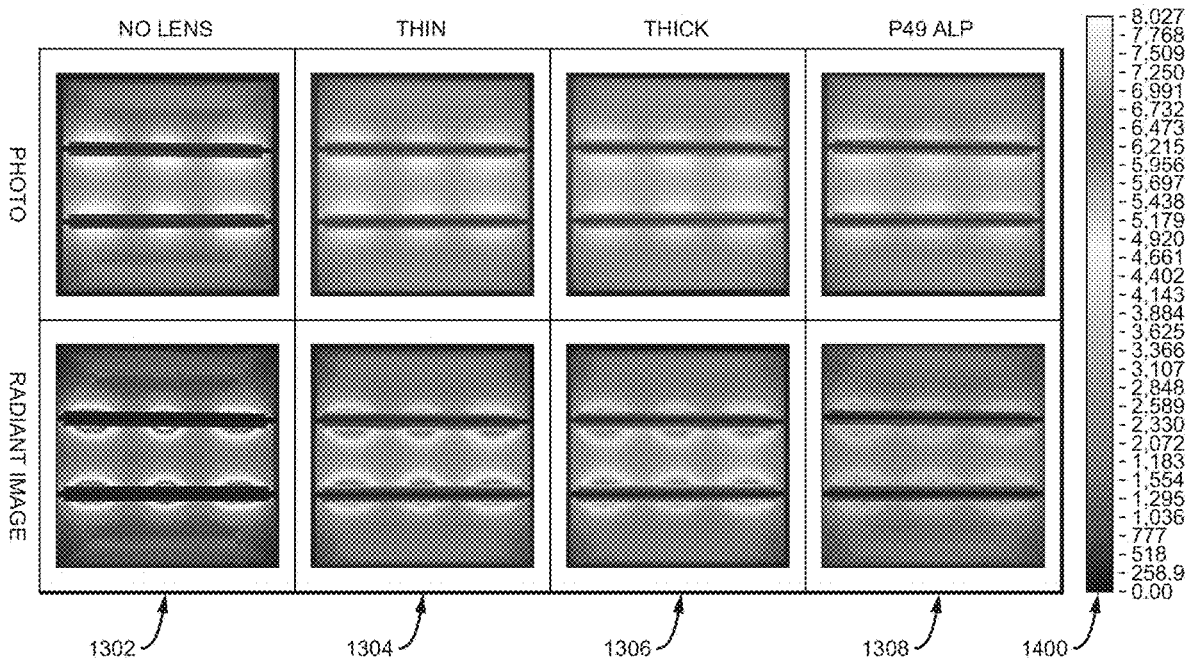
FIG. 14 is a nadir view and a radiant image nadir view of the four troffers shown in FIG. 13.

FIG. 14 shows nadir and experimental radiant image views of the troffers 1302, 1304, 1306, 1308 from FIG. 13. The radiant images of the troffers, shown below the actual images, show the luminance (lumens per unit area) of the light from the three emitter clusters, where the luminance correlates to the scale 1400. As FIG. 14 shows, the luminance is highest closest to the emitter clusters, and dissipates with distance from the emitter clusters. As can also be seen, the troffer 1302 exhibits an area of very high luminance near the emitter clusters. This area of high luminance is reduced to varying degrees by the lenses used in troffers 1304, 1306, 1308.

Figure 15:
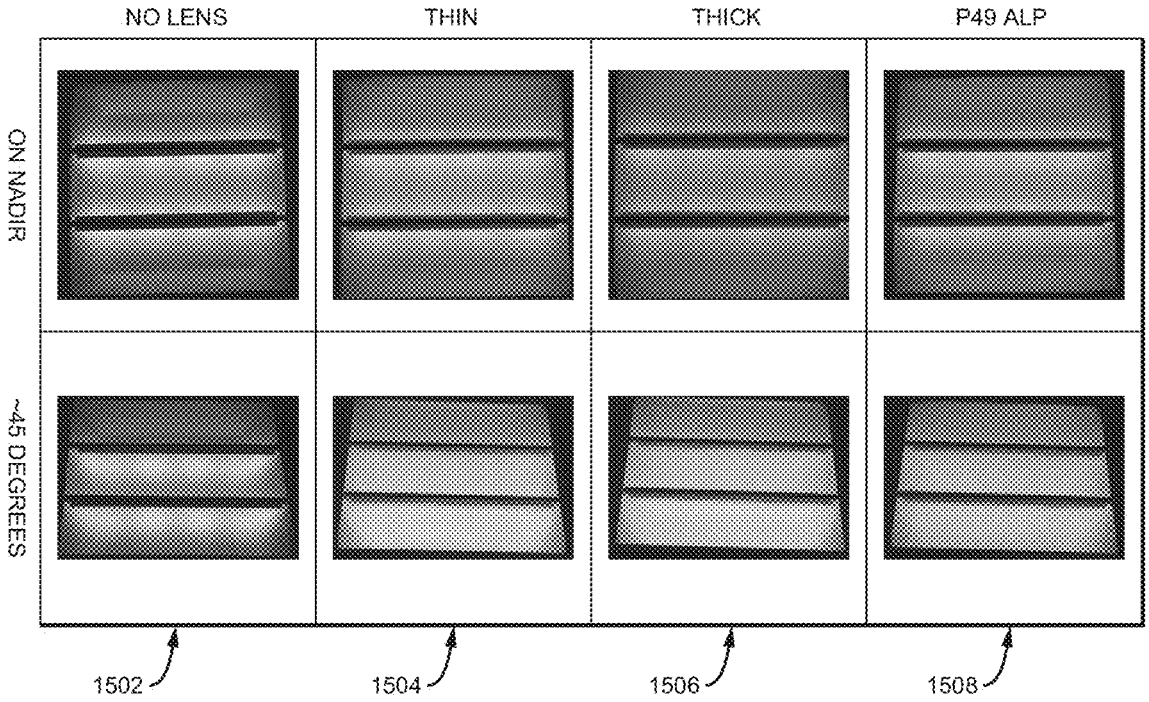
FIG. 15 is a nadir view and a 45° off-nadir view of four troffers according to embodiments of the present invention.

FIG. 15 is a compilation of nadir and 45° off-nadir views of four different troffers according to the present invention. Each of the troffers 1502, 1504, 1506, 1508 comprises two light bars, each with four emitter clusters. The troffer 1102 does not comprise a lens. The troffer 1504 and the troffer 1506 comprise lenses incorporating a thin and thick film respectively, such as thin and thick versions of the film 522 in FIG. 5C. The troffer 1108 comprises a P49 male conical prismatic acrylic lens available from A.L.P. Lighting Components, Inc. and similar in some respects to the lenses 500 and 510 in FIGS. 5A and 5B, respectively. The troffers 1502, 1504, 1506, 1508 emit at approximately 4000K.

Figure 16:
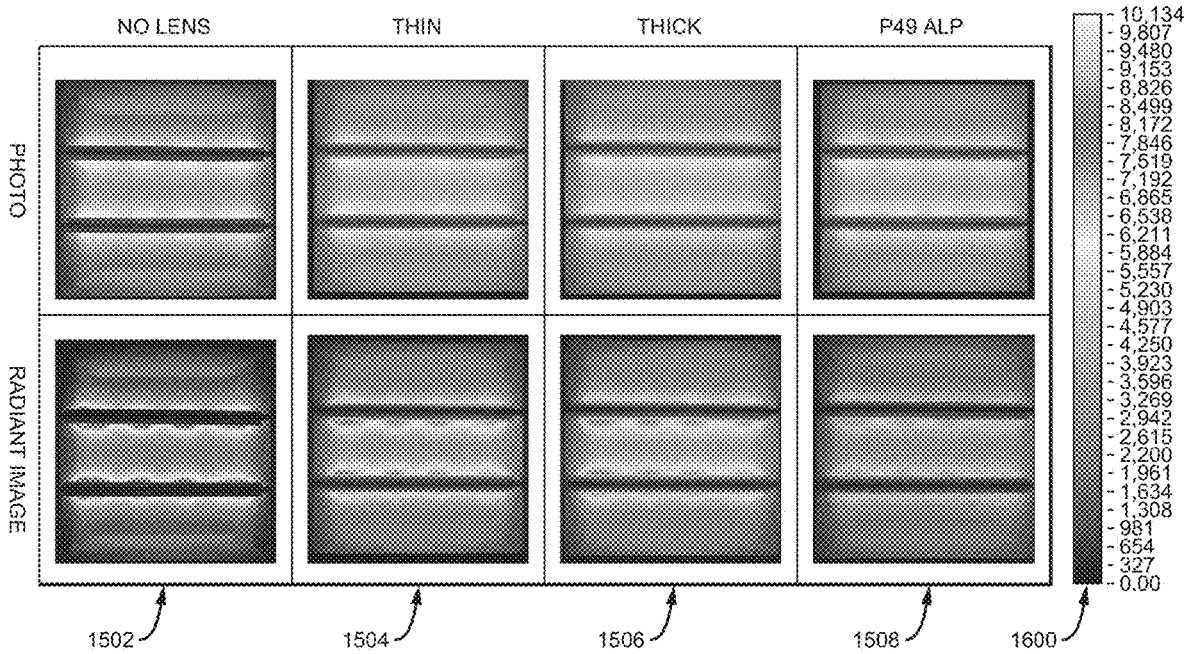
FIG. 16 is a nadir view and a radiant image nadir view of the four troffers shown in FIG. 15.

FIG. 16 shows nadir and experimental radiant image views of the troffers 1502, 1504, 1506, 1508 from FIG. 15. The radiant images of the troffers, shown below the actual images, show the luminance of the light from the three emitter clusters, where the luminance correlates to the scale 1600. As FIG. 16 shows, the luminance is highest closest to the emitter clusters, and dissipates with distance from the emitter clusters. As can also be seen, the troffer 1502 exhibits an area of very high luminance near the emitter clusters. This area of high luminance is reduced to varying degrees by the lenses used in troffers 1504, 1506, 1508.

Figure 17:
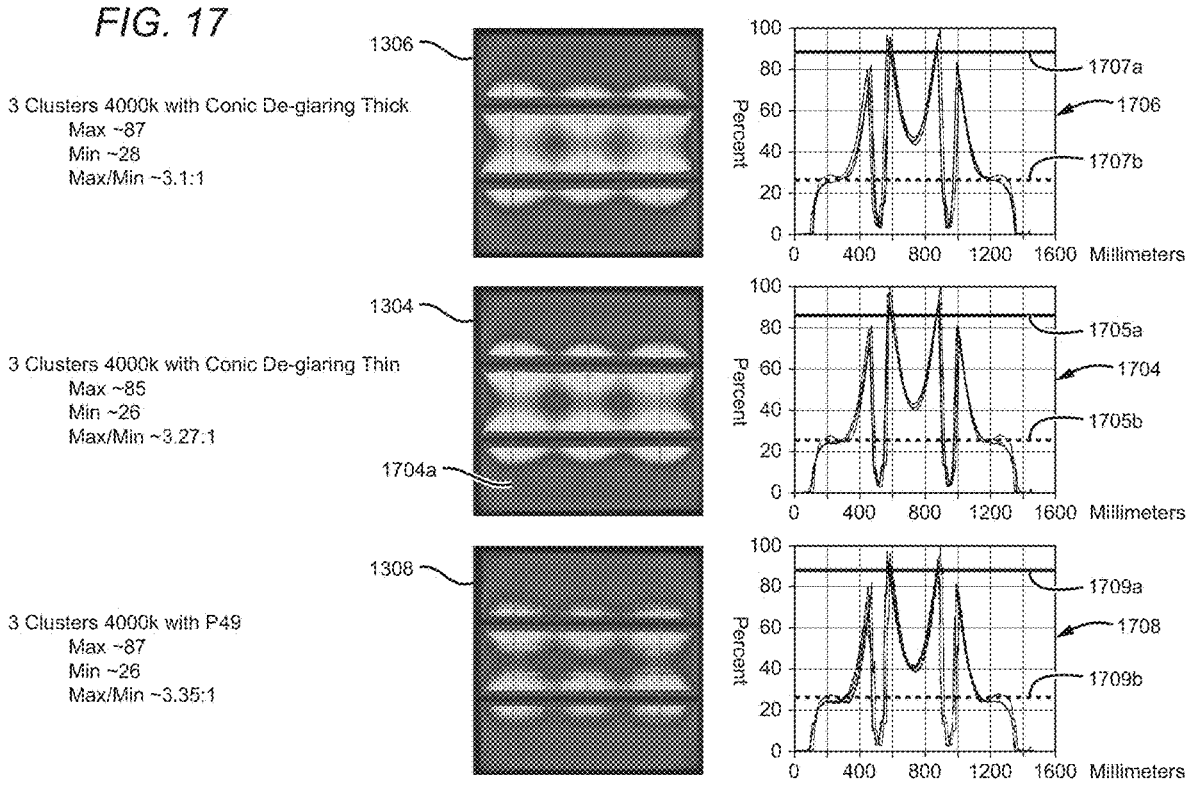
FIG. 17 is a radiant image nadir view and corresponding intensity distribution graph of three troffers according to embodiments of the present invention.

FIG. 17 shows experimental radiant images of the troffers 1304, 1306, 1308, with corresponding intensity distribution graphs 1704, 1706, 1708. The graphs 1704, 1706, 1708 are taken along a line perpendicular to the center of two emitter clusters, for example a line 1704*a*, and show relative intensity (relative to the maximum, shown as 100%) for any coordinate along the given line. As generally shown by the graph 1704, which shows the intensity distribution of the troffer 1304 with a lens plate with a thin film, the intensity reaches a first peak on the outside edge of a light bar, dips directly below the light bar, and reaches a second peak on the inside edge of a light bar. This is approximately mirrored on the other side of the graph 1704, with a saddle between the two high peaks representing the intensity distribution between the light bars of the troffer 1304. This general pattern is approximately followed by the graphs 1706, 1708.

The lines 1705*a* and 1705*b*, 1707*a* and 1707*b*, and 1709*a* and 1709*b* show the max and min of the graphs 1704, 1706, 1708, respectively, as calculated by a person of ordinary skill in the art. The troffer 1304 with a lens with a thin film has an experimental max of about 85 and an experimental min of about 26, for a max/min ratio of about 3.27. The troffer 1306 with a lens with a thick film has an experimental max of about 87 and an experimental min of about 28, for a max/min ratio of about 3.1. The troffer 1308 with a P49 lens has an experimental max of about 87 and an experimental min of about 26, for a max/min ratio of about 3.35.

Figure 18:
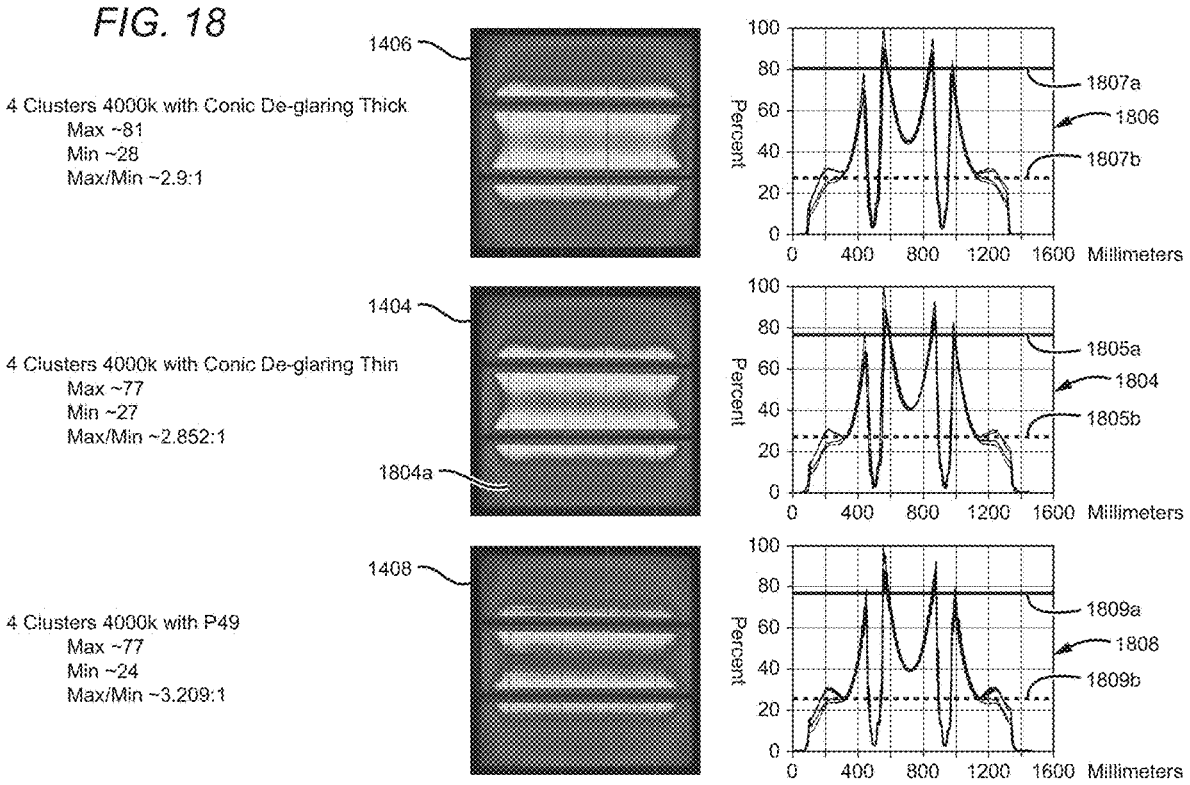
FIG. 18 is a radiant image nadir view and corresponding intensity distribution graph of three troffers according to embodiments of the present invention.

FIG. 18 shows experimental radiant images of the troffers 1404, 1406, 1408, with corresponding intensity distribution graphs 1804, 1806, 1808. The graphs 1804, 1806, 1808 are taken along a line perpendicular to the center of two emitter clusters, for example a line 1804*a*. As generally shown by the graph 1804, which shows the intensity distribution of the troffer 1404 with a lens plate with a thin film, the intensity reaches a first peak on the outside edge of a light bar, dips directly below the light bar, and reaches a second peak on the inside edge of a light bar. This is approximately mirrored on the other side of the graph 1804, with a saddle between the two high peaks representing the intensity distribution between the light bars of the troffer 1404. This general pattern is approximately followed by the graphs 1806, 1808.

The lines 1805*a* and 1805*b*, 1807*a* and 1807*b*, and 1809*a* and 1809*b* show the max and min of the graphs 1804, 1806, 1808, respectively, as calculated by a person of ordinary skill in the art. The troffer 1404 with a lens with a thin film has an experimental max of about 77 and an experimental min of about 27, for a max/min ratio of about 2.852. The troffer 1406 with a lens with a thick film has an experimental max of about 1 and an experimental min of about 28, for a max/min ratio of about 2.9. The troffer 1408 with a P49 lens has an experimental max of about 77 and an experimental min of about 24, for a max/min ratio of about 3.209. One embodiment of a troffer according to the present invention has a max/min ratio of less than about 3.5. Another embodiment of a troffer according to the present invention has a max/min ratio of less than about 3.

FIG. 19 is a polar intensity distribution graph of experimental data 1902 and modeled data 1904 for the troffer 1302 from FIG. 13. The troffer 1302 does not comprise a lens. The experimental data was measured using a goniometer. Model data in the current application is the result of analyses performed using LightTools®. LightTools® is a 3D optical engineering and design software product used to predict light output characteristics. It is a known tool to those skilled in the art of optical engineering, and is known to produce verifiable predictable light output models that correlate with the output characteristics of final products. As can be seen in FIG. 19, the correlation between the experimental data 1902 and the modeled data 1904 is high.

Figure 20:
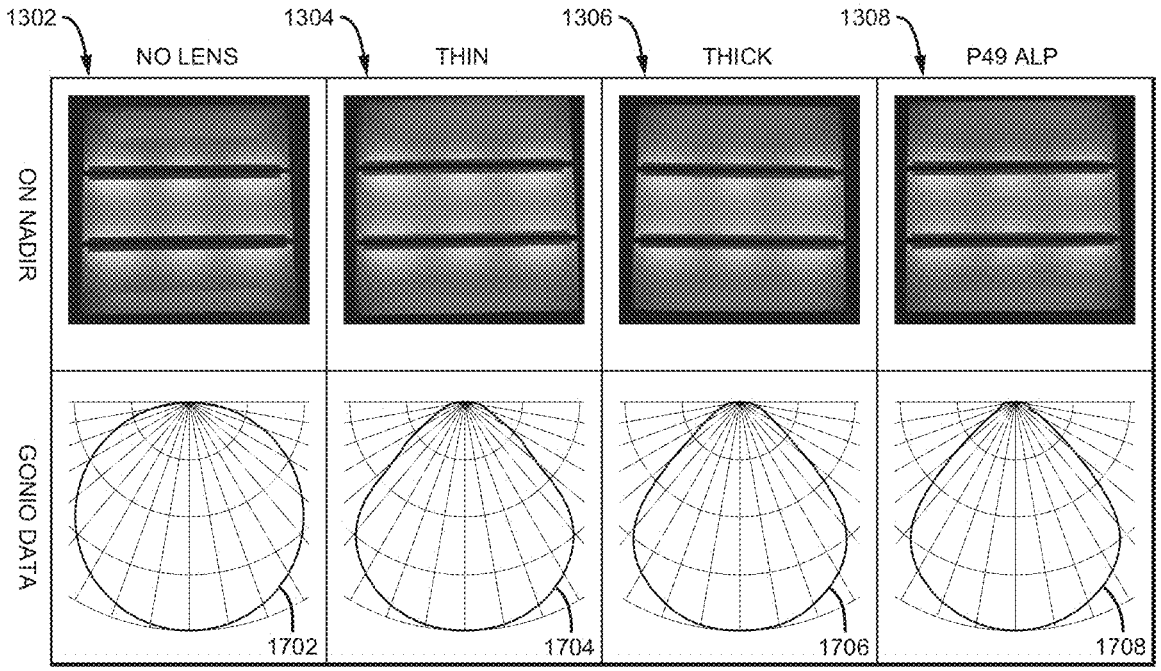
FIG. 20 is a nadir view and corresponding polar intensity distribution graph of the troffers shown in FIG. 13.

FIG. 20 shows nadir views of the troffers 1302, 1304, 1306, 1308, with corresponding intensity distributions 1702, 1704, 1706, 1708 measured using a goniometer. FIG. 21 shows the intensity distributions 1704, 1706, and 1708 on a single graph. As can be seen, the troffers 1304, 1306, 1308 comprising lenses redistribute more light to low angles, or in on embodiment redistribute more light downward into a room. This effect is more intense with the thick film lens of the troffer 1306 than with the thin film lens of the troffer 1304. The troffer 1308 with a P49 lens has a slightly lower max intensity than the troffer 11306, but redistributes slightly more light to intermediate angles.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

We claim:

1. A lighting troffer, comprising:

a back reflector;

a door frame comprising an opening having a length and a width, wherein the door frame is removably connected to the back reflector;

at least one light bar spanning, at least partially, the length or the width of the opening and being at least partially housed by the back reflector, wherein the light bar comprises two ends, the two ends being connected to the door frame to thereby support the light bar, the light bar comprising a mount surface for supporting a plurality of light emitters, and the plurality of light emitters on the mount surface for emitting light towards the back reflector;

at least one lens plate supported by the light bar and the door frame covering the opening of the door frame, wherein the door frame at least partially holds the at least one lens plate in place; and wherein a region between the mount surface and the back reflector defines a mixing chamber for mixing the light emitted by the plurality of light emitters.

2. The lighting troffer of claim 1, wherein the at least one light bar, the at least one lens plate and the door frame define an externally visible surface where a majority of the visible surface of the troffer is luminous.

3. The lighting troffer of claim 2, wherein at least 75 percent of the visible surface of the troffer is luminous.

4. The lighting troffer of claim 1, wherein the mount surface is configured such that at least some of the light emitted from the plurality of light emitters is initially incident on the back reflector.

5. The lighting troffer of claim 1, wherein the at least one lens plate comprises at least two lens plates, wherein the door frame at least partially holds each of the at least two lens plates in plate.

6. The lighting troffer of claim 1, wherein the at least One lens plate is faceted.

7. The lighting troffer of claim 1, wherein the at least one lens plate comprises a plurality of thin films.

8. The lighting troffer of claim 1, wherein the troffer provides an output having an intensity max/min ratio of less than about 3.5.

9. The lighting troffer of claim 1, wherein the troffer provides an output having an intensity max/min ratio of less than about 3.

10. The lighting troffer of claim 1, wherein the back reflector comprises a diffuse white reflector.

11. The lighting troffer of claim 1, wherein the back reflector comprises a reflective coating.

12. The lighting troffer of claim 1, wherein a cross-section of the back reflector is substantially trapezoidal.

13. The lighting troffer of claim 1, wherein the back reflector comprises rounded corners.

14. The lighting troffer of claim 1, wherein the back reflector comprises a stepped surface.

15. The lighting troffer of claim 1, wherein the back reflector is textured.

16. The lighting troffer of claim 1, wherein the back reflector comprises a prismatic pattern.

17. The lighting troffer of claim 1, wherein at least one of the plurality of light emitters has an emission pattern that is more an omnidirectional than a Lambertian emission pattern.

18. The lighting troffer of claim 1, wherein the plurality of light emitters comprise blue-shifted yellow (BSY) and red emitters.

19. The lighting troffer of claim 1, wherein the mount surface comprises a first flat area and a second flat area;

wherein the plurality of light emitters comprises a first light emitter on the first flat area and a second light emitter on the second flat area;

wherein the first flat area is configured such that at least some light emitted from the first light emitter is initially incident on a first portion of the back reflector; and wherein the second flat area is configured such that at least some light emitted from the second emitter is initially incident on a second portion of the back reflector.

20. The lighting troffer of claim 1, wherein the plurality of light emitters comprises a plurality of LEDs on at least one light strip, wherein the plurality of LEDs face the hack reflector.

21. The lighting troffer of claim 1, wherein the plurality of light emitters comprises a first plurality of LEDs on a first light strip and a second plurality of LEDs on a second light strip wherein the first plurality of LEDs face a first portion of the back reflector and the second plurality of LEDs face a second portion of the back reflector.

22. The lighting troffer of claim 1, wherein the door frame comprises a mount surface on which at least one light emitter is mounted.

23. A lighting troffer, comprising:

a back reflector;

a door frame removably connected to the back reflector defining an opening having a length and a width;

a plurality of light bars spanning, at least partially, at least one of the width and the length of the opening of the door frame, each of the plurality of light bars having a first end and a second end connected to the door frame to thereby support the plurality of light bars on the door frame, each of the plurality of light bars having a mount surface for supporting a plurality of light emitters;

the plurality of light emitters on the mount surfaces of the plurality of light bars, the plurality of light emitters emitting light toward the hack reflector;

at least one lens plate supported by the light bar and the door frame covering the opening wherein a region between the plurality of light emitters and the back reflector defines a mixing chamber for mixing the light emitted by the plurality of light emitters.

24. A lighting troffer, comprising:

a back reflector;

a door frame defining an opening having a length and a width, wherein the door frame is pivotably connected to the back reflector such that the door frame is movable between a first position where the door frame is spaced from the back reflector and a second position where the door frame defines a lower perimeter of the lighting troffer;

at least one light bar comprising a mount surface for supporting a plurality of light emitting diodes, the at least one light bar having a first end and a second end, wherein the at least one light bar partially spanning at least one of the length and the width of the opening; wherein the first end and a second end are spaced from the door frame;

the plurality of light emitters on the mount surface, the plurality of light emitters emitting light toward the back reflector; and at least one lens plate connected to and extending from the door frame, the at least one lens plate connected to and supporting the at least one light bar, wherein the at least one lens plate covers the opening of the door frame, wherein a region between the mount surface and the back reflector defines a mixing chamber for mixing the light emitted by the plurality of light emitters.

* * * * *